US010464582B2

(12) United States Patent
Sato et al.

(10) Patent No.: US 10,464,582 B2
(45) Date of Patent: Nov. 5, 2019

(54) CARBODY SUPPORT DEVICE AND RAILWAY VEHICLE

(71) Applicant: KAWASAKI JUKOGYO KABUSHIKI KAISHA, Kobe-shi, Hyogo (JP)

(72) Inventors: Yoshi Sato, Kobe (JP); Yukitaka Taga, Kobe (JP); Shunichi Nakao, Kobe (JP); Kazuo Isomura, Kobe (JP); Makoto Tamaki, Kobe (JP); Junichi Shirakawa, Kobe (JP); Koichi Murata, Kobe (JP)

(73) Assignee: KAWASAKI JUKOGYO KABUSHIKI KAISHA, Kobe-Shi (JP)

( * ) Notice: Subject to any disclaimer, the term of this patent is extended or adjusted under 35 U.S.C. 154(b) by 112 days.

(21) Appl. No.: 15/892,916

(22) Filed: Feb. 9, 2018

(65) Prior Publication Data

US 2018/0162419 A1 Jun. 14, 2018

Related U.S. Application Data

(62) Division of application No. 14/403,399, filed as application No. PCT/JP2013/068858 on Jul. 10, 2013, now Pat. No. 9,932,050.

(51) Int. Cl.
*B61F 5/22* (2006.01)
*B61F 5/38* (2006.01)

(52) U.S. Cl.
CPC . *B61F 5/22* (2013.01); *B61F 5/38* (2013.01)

(58) Field of Classification Search
CPC .... B61F 5/22; B61F 5/24; B61F 5/245; B61F 5/12; B61F 5/144; B61F 5/36; B61F 5/44;
(Continued)

(56) References Cited

U.S. PATENT DOCUMENTS 2,353,503 A * 7/1944 Rost ..... B60G 9/02 105/199.2
4,324,187 A 4/1982 Sambo
(Continued)

FOREIGN PATENT DOCUMENTS

FR 2146814 A5 3/1973
JP S44-009127 B 4/1969
(Continued)

OTHER PUBLICATIONS

Oct. 15, 2013 Search Report issued in International Patent Application No. PCT/JP2013/068858.
(Continued)

*Primary Examiner* — Mark T Le
(74) *Attorney, Agent, or Firm* — Oliff PLC

(57) ABSTRACT

A carbody support device of a railway vehicle, including support mechanisms installed between a front bogie and a carbody and between a rear bogie and the carbody in a traveling direction, and supporting the carbody against the respective bogies. The support mechanisms regulate both the front bogie and the rear bogie inclining in the same vehicle width direction with respect to the carbody when the railway vehicle travels through a curve, while the support mechanisms permit the front bogie and the rear bogie inclining in different vehicle width directions.

6 Claims, 30 Drawing Sheets

(58) Field of Classification Search
CPC ..... B61F 5/38; B61G 5/02; G05D 1/0891; B60G 2300/10; B60G 2800/012
See application file for complete search history.

(56) References Cited

U.S. PATENT DOCUMENTS

| | | | | |
|---|---|---|---|---|
| 5,454,329 | A * | 10/1995 | Liprandi | B61F 5/245 105/171 |
| 5,558,024 | A * | 9/1996 | Solera | B61F 5/22 105/199.2 |
| 5,784,969 | A * | 7/1998 | Steidl | G05D 1/0891 105/199.2 |
| 5,943,962 | A * | 8/1999 | Birkhahn | B61F 5/245 105/199.2 |
| 2009/0260537 | A1 | 10/2009 | Brundisch et al. | |
| 2011/0001301 | A1 | 1/2011 | Li et al. | |
| 2012/0118194 | A1* | 5/2012 | Schneider | B61F 5/24 105/171 |

FOREIGN PATENT DOCUMENTS

| | | | |
|---|---|---|---|
| JP | H02-12973 | U | 1/1990 |
| JP | H02-227365 | A | 9/1990 |
| JP | H02-227366 | A | 9/1990 |
| JP | H03-178862 | A | 8/1991 |
| JP | H06-127381 | A | 5/1994 |
| JP | 2001-506560 | A | 5/2001 |
| JP | 2001-334937 | A | 12/2001 |
| JP | 2002-046603 | A | 2/2002 |
| JP | 2002-87258 | A | 3/2002 |
| JP | 2002-347619 | A | 12/2002 |
| JP | 2002-356163 | A | 12/2002 |
| JP | 2003-054403 | A | 2/2003 |
| JP | 2005-096724 | A | 4/2005 |
| JP | 2006-281969 | A | 10/2006 |
| JP | 2007-269076 | A | 10/2007 |
| JP | 2008-056195 | A | 3/2008 |
| JP | 2010-076608 | A | 4/2010 |
| JP | 2010-173354 | A | 8/2010 |
| JP | 2011-514277 | A | 5/2011 |
| KR | 2010-0076671 | A | 7/2010 |
| WO | 98/28160 | A1 | 7/1998 |

OTHER PUBLICATIONS

Feb. 26, 2016 Search Report issued in European Patent Application No. 13817277.0.

Apr. 1, 2016 Office Action issued in Korean Patent Application No. 10-2014-7035309.

U.S. Appl. No. 14/403,399, filed Nov. 24, 2014 in the name of Sato et al.

U.S. Appl. No. 15/892,808, filed Feb. 9, 2018 in the name of Sato et al.

* cited by examiner

CARBODY SUPPORT DEVICE AND RAILWAY VEHICLE

TECHNICAL FIELD

This is a Division of U.S. application Ser. No. 14/403,399 filed Nov. 24, 2014, which is a National Stage of International Application No. PCT/JP2013/068858 filed Jul. 10, 2013, which claims the benefit of Japanese Application No. 2012-157877 filed Jul. 13, 2012 and Japanese Application No. 2013-035607 filed Feb. 26, 2013. The disclosures of the prior applications are hereby incorporated by reference herein in their entireties.

The present invention relates to a carbody support device for reducing variations in wheel load on a railway vehicle, and to a railway vehicle provided with the carbody support device.

BACKGROUND ART

In a railway vehicle, although the weight of the vehicle acts on rails through respective wheels, a vertical load acting on each wheel is referred to as "the wheel load." Moreover, the balance of the wheel loads between the respective wheels varies and, thus, a state where the wheel load on a certain wheel becomes extremely small is referred to as "the decrease in wheel load."

Meanwhile, since the orbit changes from a plane state into a cant state with the distance at an entrance part into an orbital curve (transition curve part) as shown in FIG. 26, the orbit becomes in a twisted state as seen from the carbody. If a railway vehicle where an existing rigid carbody is supported by bogies via normal suspensions travels through such a curved cant gradually decreasing section, the decrease in wheel load may occur at a front wheel on the outside rail (part 3*b* shown in FIG. 26) due to the orbital torsion especially during traveling an exit part of the curve.

As the countermeasure, as disclosed, for example, in Patent Documents 1 and 2, devices installed between the carbody and the bogies and for controlling the heights of air springs for supporting the carbody (i.e., the pressures in the air springs) to reduce the occurrence of the decrease in wheel load, have been proposed.

In a freight train, so-called indirect-mounting bogies are normally used, and the carbody is supported by bolsters via side bearers and center pivots. The bolsters are supported by a bogie frame via bolster springs, and the bolster springs support a force in the roll directions. In the freight train, there is a special nature that loads acting on the bogies change a lot between an empty-vehicle state and a loaded state.

If there is initial torsion between supporting points of the front bogie and the rear bogie of the carbody, unbalance may occur mainly in the bolster spring supporting heights of each of the front and rear bogies and, thereby, unbalance may occur in static load on the left and right wheels respectively in the front and rear bogies. This unbalance in the static load on the left and right wheels may promote the decreases in wheel load when traveling through the curve.

As the countermeasure, for example, Patent Documents 3 and 4 have proposed a technique to achieve equalization of the bolster spring supporting heights of each of the front and rear bogies, against the initial torsion of the carbody, by inserting liners in bolster spring supporting parts of the front and rear bogies, respectively.

REFERENCE DOCUMENTS OF CONVENTIONAL ART

Patent Documents

[Patent Document 1] JP2010-173354A
[Patent Document 2] JP2007-269076A
[Patent Document 3] JP2002-347619A
[Patent Document 4] JP2010-076608A

DISCLOSURE OF THE INVENTION

Problem(s) to be Solved by the Invention

However, in the conventional arts, since the decrease in wheel load is suppressed by actively controlling the air spring internal pressures as described above, the suppressing operation of the decrease in wheel load cannot be performed any longer if a problem occurs in the control operation itself, such as a loss of control, for example, and, thus, the displacement in the orbital torsion with respect to the carbody cannot be absorbed. As described above, the conventional arts have only achieved a superficial measure to prevent the decrease in wheel load, and have not yet reached a radical settlement in which the displacement in the orbital torsion with respect to the carbody is absorbed.

Further, in the freight train, because of its special nature, the bolster springs have to be applicable to a wide range of load and have to satisfy restrictions of the vertical displacement, and, therefore, the bolster springs cannot be set too soft. As a result, especially in the empty-vehicle state, the rigidity in the torsional directions at the front and rear of the vehicle relatively increases, and the decrease in wheel load tends to increase between the front and rear bogies, for example, in an orbital torsion section of a sharp curve. Therefore, it is necessary to absorb the displacement in the orbital torsion with respect to the carbody also in the freight train.

Further, as described above, when there is the initial torsion between the supporting points of the front and rear bogies of the carbody, since it is necessary to adjust the liners in order to achieve the equalization of the bolster spring supporting heights of each of the front and rear bogies, there is a problem that the adjustment is burdensome.

The present invention is made in order to solve such problems, and one purpose of the present invention is to provide a carbody support device which can absorb a displacement in an orbital torsion with respect to a carbody without performing an active control operation, and provide a railway vehicle provided with the carbody support device.

Further, another purpose of the present invention is to provide a carbody support device which can easily reduce a static wheel load unbalance of each of the front and rear bogies which is occurred due to initial torsion of the carbody, and to provide a railway vehicle provided with the carbody support device.

Summary of the Invention

In order to achieve the purposes described above, the present invention is configured as follows. That is, according to the first aspect of the present invention, a carbody support device of a railway vehicle including support mechanisms respectively installed between a front bogie and a carbody and between a rear bogie and the carbody in a traveling direction, and supporting the carbody against the respective bogies. The support mechanisms regulate both the front bogie and the rear bogie inclining in the same vehicle width direction with respect to the carbody when the railway vehicle travels through a curve, while the support mechanisms permit the front bogie and the rear bogie inclining in different vehicle width directions.

By being configured as described above, in a case that the railway vehicle travels-the curve, when the orbital cant differs at the front bogie and the rear bogie, the support mechanisms permit the inclinations of the front bogie and the rear bogie in the different vehicle width directions with respect to the carbody. Therefore, even when the vehicle travels through a curved cant gradually decreasing section, occurrence of a decrease in wheel load can be prevented. Further, since the support mechanisms are not for conventionally preventive measures of the decrease in wheel load including electric controls, the reliability is very high compared with the conventional measures.

Moreover, according to the second aspect of the present invention, a railway vehicle includes the carbody support device according to the first aspect.

Effects of the Invention

According to the carbody support device according to the first aspect and the railway vehicle according to the second aspect, the carbody support device which can absorb a displacement in orbital torsion with respect to the carbody without performing an active control operation, and the railway vehicle provided with the carbody support device, can be provided.

According to the carbody support device and the railway vehicle, static wheel load unbalance of each of the front and rear bogies caused by initial torsion of the carbody can be easily reduced, without performing, for example, liner adjustments.

MODE(S) FOR CARRYING OUT THE INVENTION

Figure 1A:
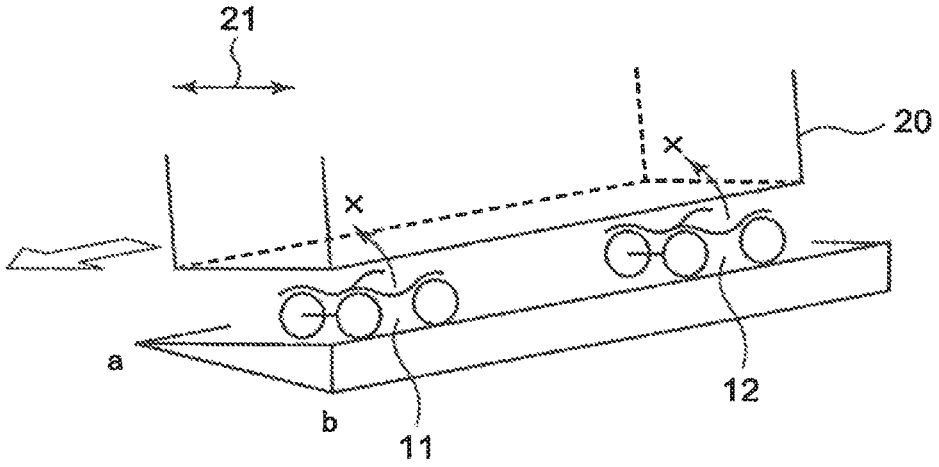
FIG. 1A is a perspective view conceptionally illustrating operation of a carbody support device in one embodiment, and is a view illustrating a case where cants at front and rear bogies are same.

Hereinafter, a carbody support device and a railway vehicle provided with the carbody support device which are one embodiment will be described with reference to the accompanying drawings. Note that in each drawing, same or similar components are denoted by same reference numerals. Moreover, each drawing schematically illustrates the conceptual configuration, and the shape, size, and scale of each part do not correspond to an actual component. In addition, between the same or similar components, even if the illustrated shapes, sizes, and forms are different, the differences are not intentional. In order to avoid the following explanation becomes unnecessarily redundant and facilitate understanding of the following explanation by a person skilled in the art, detailed explanation of the matters already well known and repeating explanation of substantially the same configurations may be omitted. Further, the following explanation and the contents of the accompanying drawings are not intended to limit the subject matters described in the claims.

The carbody support device of this embodiment is not a device for preventing a decrease in wheel load of a single wheel within a bogie of a railway vehicle, but it is a device for preventing the decreases in wheel load between the front and rear bogies of a single vehicle, and includes a support mechanism. The support mechanism is comprised of mechanisms, each installed between the front bogie and the carbody, and between the rear bogie and the carbody, respectively, and supports the carbody against each bogie. The carbody support device of this embodiment has features especially in regulating that the front bogie and the rear bogie together incline in the same vehicle width direction with respect to the carbody when traveling through a curve, while permitting the inclinations in different directions. More specifically, when a cant of the orbit at the front bogie and a cant at the rear bogie are inclinations in the same direction and at the same angle, the support mechanism acts so as to regulate the inclinations of the front bogie and the rear bogie together in the same vehicle width direction with respect to the carbody. On the other hand, when both cants differ in the inclination, the support mechanism acts so as to permit the inclinations in different directions.

For example, in a state shown in FIG. 1A, the cant at a front bogie 11 and the cant at a rear bogie 12 are same. In this case, the support mechanism acts so as to regulate further inclinations of the front bogie 11 and the rear bogie 12 together in the same vehicle width direction with respect to a carbody 20. Thereby, neither the front bogie 11 nor the rear bogie 12 inclines greatly toward "a" side (inclination trough side).

Figure 1B:
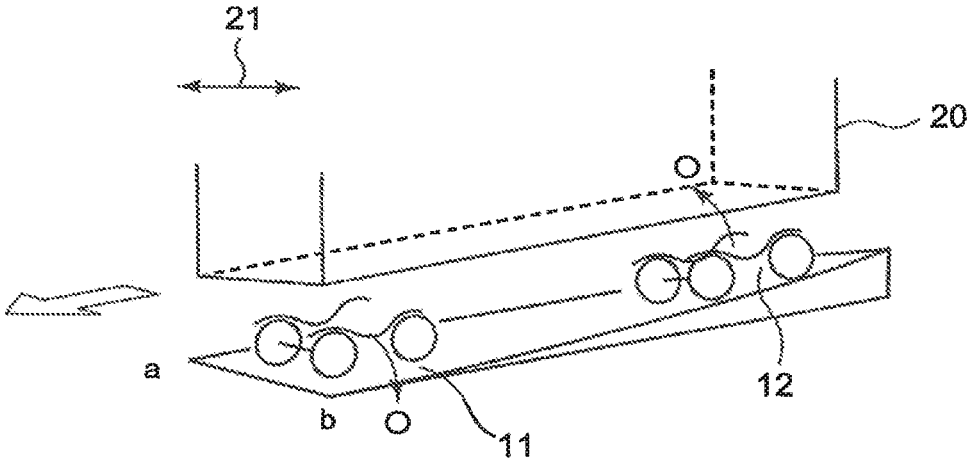
FIG. 1B is a perspective view conceptionally illustrating operation of the carbody support device in one embodiment, and is a view illustrating a case where the front and rear bogies are located in a cant gradually decreasing section.

On the other hand, in a state shown in FIG. 1B, the cant at the front bogie 11 differs from the cant at the rear bogie 12. In such a situation, the support mechanism acts so as to permit that the front bogie 11 and the rear bogie 12 incline in different vehicle width directions 21. Thus, the rear bogie 12 can incline toward the "a" side, and despite the carbody 20 inclines toward the "a" side because the rear bogie 12 is located within the cant section, the front bogie 11 can incline toward "b" side. In other words, although the front bogie 11 and the rear bogie 12, and the carbody of a single vehicle are mutually pivotable in torsional directions (i.e., rotation to the different directions) by providing the support mechanisms, the vehicle has a structure with rigidity in roll directions (i.e., rotation to the same direction).

Thus, the carbody support device which is this embodiment can prevent the decreases in wheel load of both the front and rear bogies of the single vehicle, by providing the support mechanisms. Such carbody support devices can prevent the decreases in wheel load at both the front and rear bogies, for example, especially within the cant gradually decreasing section of a sharp curve, such as in a subway line. Even if the vehicle is limited in characteristics of secondary suspension (e.g., bolster spring) due to a large load change before and after loading, such as a freight train, the decreases in wheel load between the front and rear bogies can be suppressed, for example, in an orbital torsion section of the sharp curve. Below, particular examples of the configuration of such support mechanisms are described one by one.

Embodiment 1

Figure 2:
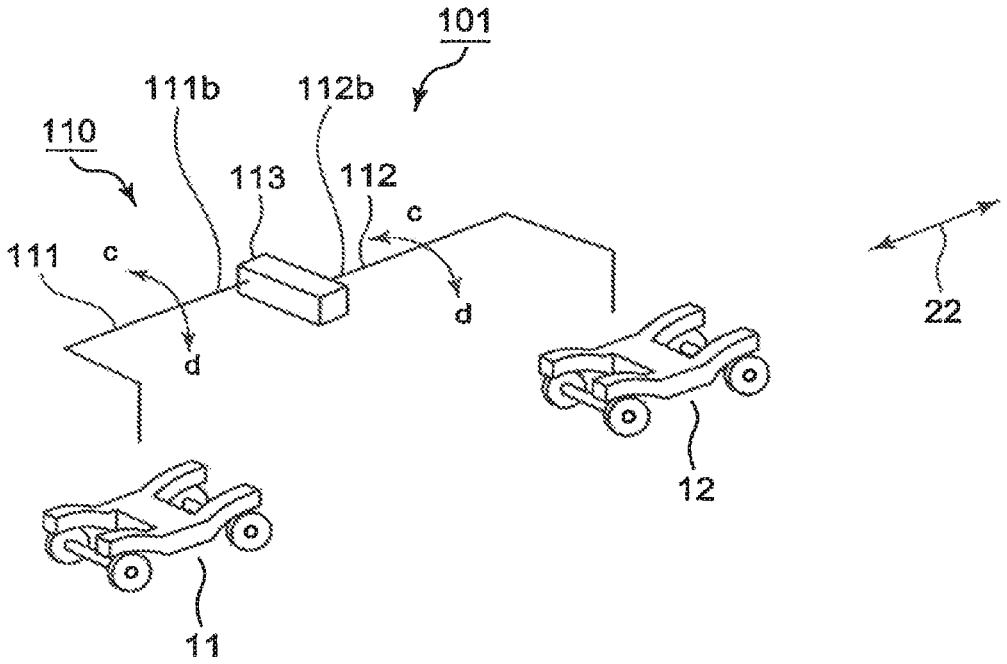
FIG. 2 is a perspective view conceptionally illustrating operation of a carbody support device of Embodiment 1.

One of the examples of the particular configuration of the support mechanisms conceptually described with reference to FIGS. 1A and 1B will be described with reference to FIG. 2. A support mechanism 110 of a carbody support device 101 in this embodiment 1 includes a first anti rolling bar 111, a second anti rolling bar 112, and a reversing mechanism 113.

The first anti rolling bar 111 is comprised of, for example, a torsion bar made of metal, such as steel, and extends in vehicle longitudinal directions 22 from the front bogie 11 side. The first anti rolling bar 111 is pivotable about an axis thereof, and both ends thereof are supported by bearings under the carbody. The second anti rolling bar 112 is comprised of, for example, a torsion bar similar to the first anti rolling bar 111, and extends in the vehicle longitudinal directions 22 from the rear bogie 12 side. The second anti rolling bar 112 is pivotable about an axis thereof, and both ends thereof are supported by bearings under the carbody. Note that, in this embodiment, although the first anti rolling bar 111 and the second anti rolling bar 112 are bar members, such as torsion bars, they may be, but not limited to, any members having similar functions.

The reversing mechanism 113 is a mechanism coupling an end 111*b* of the first anti rolling bar 111 away from the front bogie 11 to an end 112*b* of the second anti rolling bar 112 away from the rear bogie 12, and for reversing the rotating direction about the axis of the first anti rolling bar 111 and the rotating direction about the axis of the second anti rolling bar 112. For example, when the first anti rolling bar 111 is twisted in a "c" direction, the reversing mechanism 113 rotates the second anti rolling bar 112 in a "d" direction, but regulates the rotation to the same "c" direction.

As one example of the reversing mechanism 113 which performs such operation, gears may be used. That is, the reversing mechanism 113 has a configuration in which the reversing mechanism 113 includes a first gear provided to the end 111*b* of the first anti rolling bar 111 away from the front bogie 11 and a second gear provided to the end 112*b* of the second anti rolling bar 112 away from the rear bogie 12, and the gears are engaged with each other.

According to the carbody support device 101 thus configured, the operation described with reference to FIGS. 1A and 1B can be achieved, and the decrease in wheel load can be prevented per (front or rear) bogie of the single vehicle.

In the following Embodiments 2-4, a configuration example of the carbody support device provided with the support mechanism 110 having the first anti rolling bar 111, the second anti rolling bar 112, and the reversing mechanism 113 described above will be further described.

Embodiment 2

Figure 3:
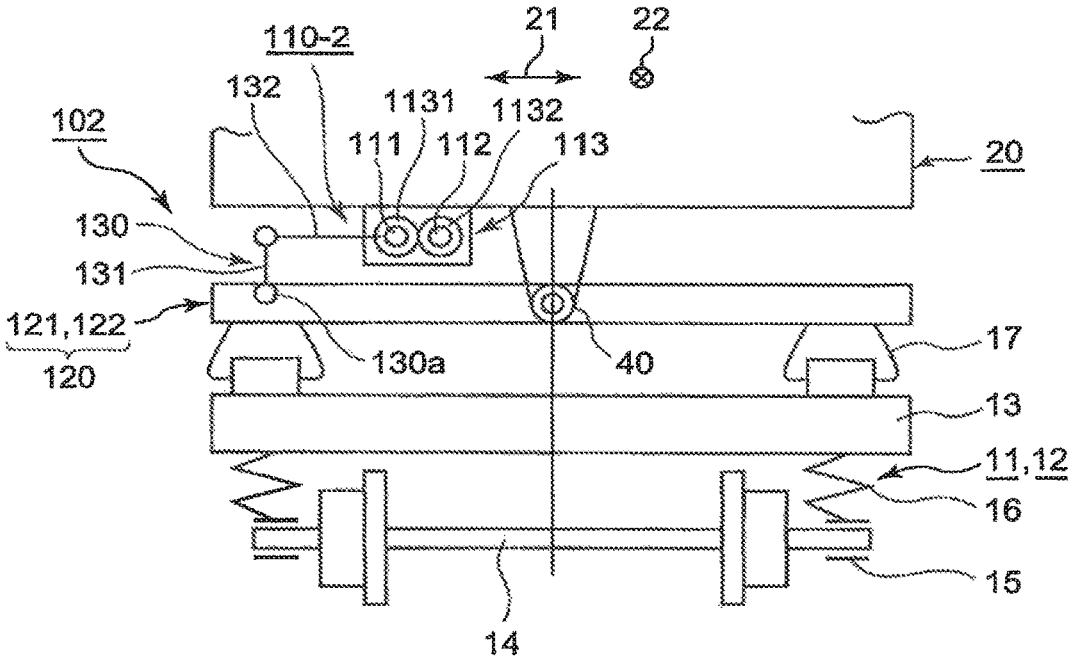
FIG. 3 is an elevational view illustrating a configuration of a carbody support device of Embodiment 2.

A carbody support device 102 of Embodiment 2 will be described with reference to FIGS. 3-7. The front bogie 11 and the rear bogie 12 included in the carbody support device 102 are bolsterless bogies, and, for example, as shown in FIG. 3, each bogie includes a bogie frame 13, a wheel set 14, journal boxes 15, axle springs 16, and air springs 17. The air spring 17 is installed on an upper surface of the bogie frame 13 on both sides in the vehicle width directions 21, respectively. Further, as shown in FIG. 3, the carbody support device 102 includes a first gear 1131 and a second gear 1132, as the reversing mechanism 113.

In the carbody support device 102 of Embodiment 2, the support mechanism 110 described above further includes a diagonal beam 120 and a coupling support mechanism 130, and the support mechanism including these components is referred to as a support mechanism 110-2 in the illustration. The diagonal beam 120 is made of metal, such as steel, and is comprised of a front diagonal beam 121 provided corresponding to the front bogie 11 and a rear diagonal beam 122 provided corresponding to the rear bogie 12, and the beams are provided under the carbody. Each diagonal beam 120 extends up to the substantially vehicle width in the vehicle width directions 21, and is rollably supported by the carbody 20 at bearings 40 at the center in the vehicle width directions. Further, each diagonal beam 120 is provided between the respective air springs 17 on both sides in the vehicle width directions 21 and the carbody 20 in each of the bogies 11 and 12, and is supported from below by the respective air springs 17.

Figure 4:
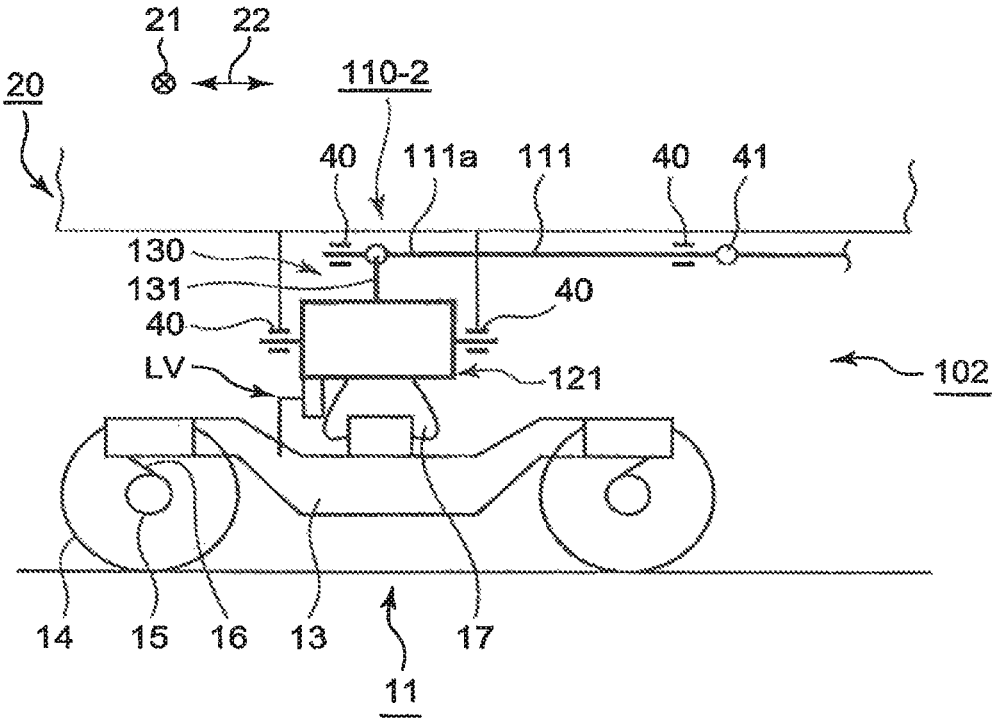
FIG. 4 is a side view illustrating the configuration of the carbody support device shown in FIG. 3.
Figure 5:
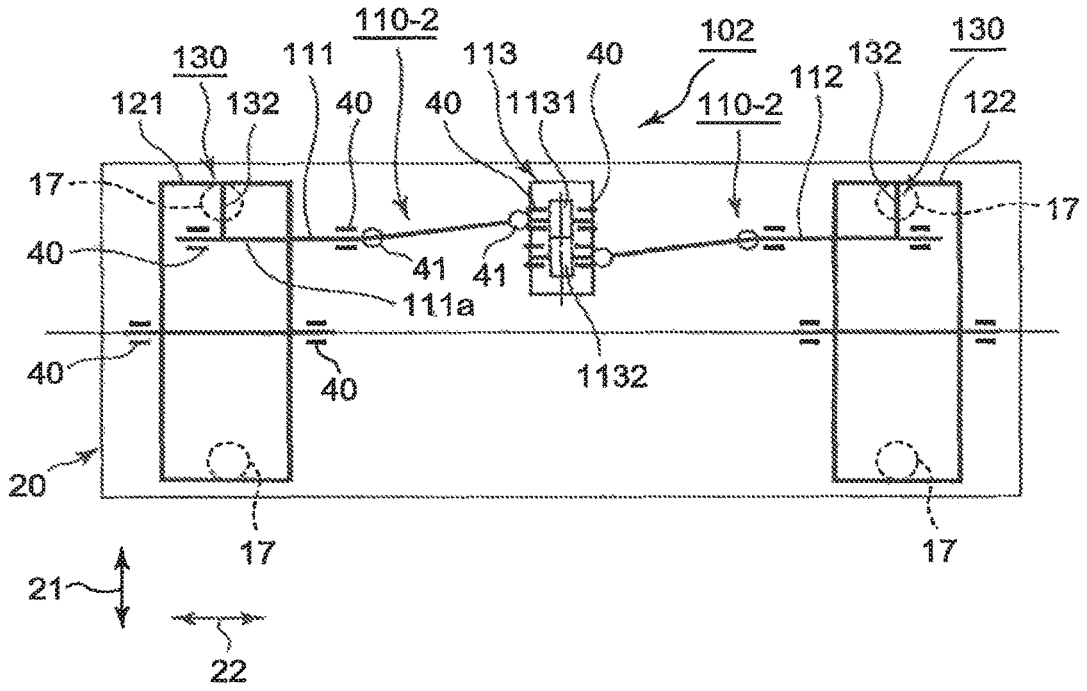
FIG. 5 is a plan view illustrating a configuration of a support mechanism provided to the carbody support device shown in FIG. 3.
Figure 6:
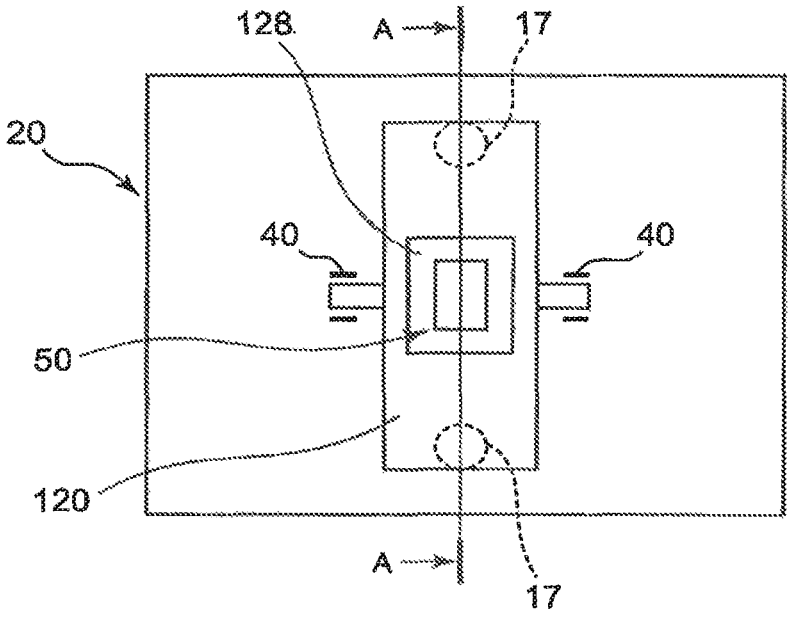
FIG. 6 is a plan view illustrating one example of a particular form of a diagonal beam provided to the carbody support device shown in FIG. 3.
Figure 7:
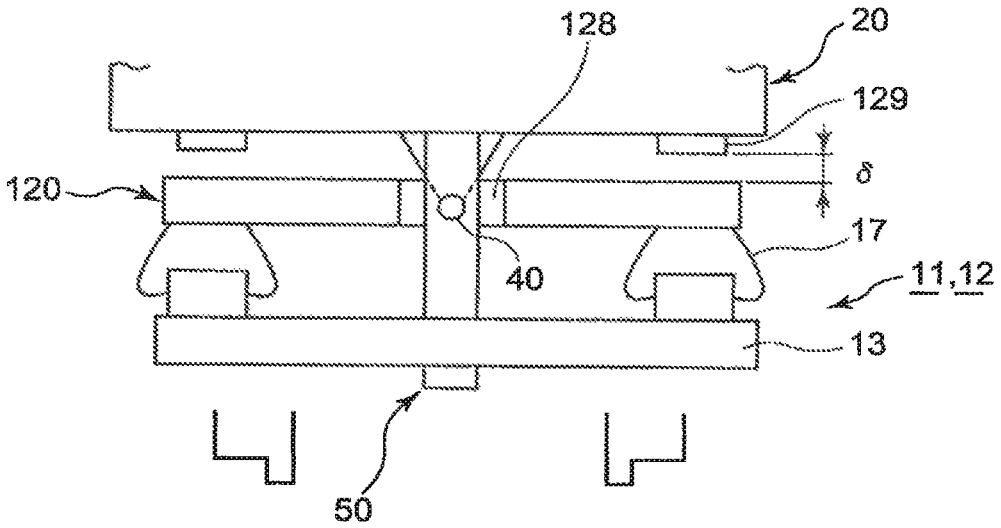
FIG. 7 is an elevational view of the diagonal beam shown in FIG. 6.

Although illustration is omitted in FIGS. 3-5, the front bogie 11 and the rear bogie 12 are bolsterless bogies as described above and the diagonal beams 120 cannot support traction. Thus, as shown in FIGS. 6 and 7, the diagonal beam 120 actually has a through-hole 128 at a central part thereof, through which a traction device 50 extending from the carbody 20 to each of the bogies 11 and 12 is penetratable. Note that FIGS. 6 and 7 are views illustrating the concept of the through-hole 128, and the shape of the through-hole 128 is not intended to limit to what is illustrated.

The diagonal beams 120 are rollable with respect to the carbody 20 as much as the amount of the orbital torsion within the cant gradually decreasing section. Therefore, in order to prevent the diagonal beam 120 from an excessive rolling displacement, a stopper 129 may be provided via a clearance δ between the bottom surface of the carbody and the diagonal beam 120, as shown in FIG. 7. Here, the clearance δ is a distance obtained by adding a margin to the amount of the orbital torsion.

The coupling support mechanism 130 includes a mechanism (front side coupling support mechanism) coupling and supporting the front diagonal beam 121 and the first anti rolling bar 111 corresponding to the front bogie 11, and a mechanism (rear side coupling support mechanism) coupling and supporting the rear diagonal beam 122 and the second anti rolling bar 112 corresponding to the rear bogie 12. The front side and rear side coupling support mechanisms 130 on the front bogie 11 side and the rear bogie 12 side are comprised of the same mechanism, and each includes a coupling member 131 and a support member 132 coupled to the coupling member 131 via a joint. The coupling member 131 is, for example, a member made of metal, such as bar steel, and a member coupling the diagonal beam 120 to the support member 132. The support member 132 is, for example, a member made of metal, such as bar steel, and a member for twisting the first anti rolling bar 111 and the second anti rolling bar 112. For example, on the front bogie 11 side, one end of the front side coupling member 131 is rotatably connected with a right or left end of the front diagonal beam 121 in the vehicle width directions 21, one end of the front side support member 132 is coupled to the front side coupling member 131 via a joint, and the other end of the front side support member 132 is fixed to a bogie side end 111*a* of the first anti rolling bar 111. Similarly, on the rear bogie 12 side, one end of the rear side coupling member 131 is rotatably connected with a right or left end of the rear diagonal beam 122, one end of the rear side support member 132 is coupled to the rear side coupling member 131 via a joint, and the other end of the rear side support member 132 is fixed to a bogie side end 112*a* of the second anti rolling bar 112.

Note that in this embodiment, as shown in FIG. 5, the first anti rolling bar 111 and the second anti rolling bar 112 are deflected in their extending directions by using a universal joint 41, between the support member 132 and the reversing mechanism 113, respectively. However, this is related to the arrangement of apparatuses on the bottom of the carbody floor and, thus it is not intended to limit to the illustrated configuration.

Further, in terms of improving the operability and the like in mounting of the coupling support mechanism 130, the coupling member 131 can have a length adjustment mechanism which can adjust the length of the vehicle in the vertical directions, as one example.

The carbody support device 102 of Embodiment 2 configured as described above operates as follows. That is, the front bogie 11 and the front diagonal beam 121, and the rear bogie 12 and the rear diagonal beam 122 are supported via the air springs 17, respectively, and each inclination of the front bogie 11 and the rear bogie 12 in the vehicle width directions 21 according to the orbital cant causes a rolling force to act independently on the front diagonal beam 121 and the rear diagonal beam 122, respectively. Therefore, for example, in the case of the cant gradually decreasing section as shown in FIG. 1B, the rear diagonal beam 122 of the rear bogie 12 receives the rolling force toward "a" on the inclination trough side, and this force twists the second anti rolling bar 112 via the coupling support mechanism 130 on the rear bogie 12 side. The twisting direction of the second anti rolling bar 112 is reversed by the reversing mechanism 113, and the first anti rolling bar 111 is then twisted. The twisting force of the first anti rolling bar 111 acts as a rolling force to the "b" side to the front diagonal beam 121 via the coupling support mechanism 130 on the front bogie 11 side. This rolling force in the front diagonal beam 121 turns into a resisting force against floating of the front bogie 11 on the outside rail, side ("b" side). As a result, the decrease in wheel load can be prevented at the outside rail side of the front bogie 11.

In the curved section with the cant as shown in FIG. 1A, since both the front diagonal beam 121 of the front bogie 11 and the rear diagonal beam 122 of the rear bogie 12 receive the rolling force to the inside rail side ("a" side on the inclination trough side), both the first anti rolling bar 111 and the second anti rolling bar 112 are twisted in the same direction. However, because of twisting in the same direction, both the first anti rolling bar 111 and the second anti rolling bar 112 are restricted in their twists by the reversing mechanism 113. Therefore, both the front diagonal beam 121 and the rear diagonal beam 122 are regulated in the rolling to the inside rail side ("a" side on the inclination trough side). As a result, the counterforce against the inclining force of the front bogie 11 and the rear bogie 12 to the inside rail side becomes greater.

Thus, the carbody support device 102 of Embodiment 2 also enables to prevent the decreases in wheel load in both the front and rear bogies of the single vehicle.

Figure 8A:
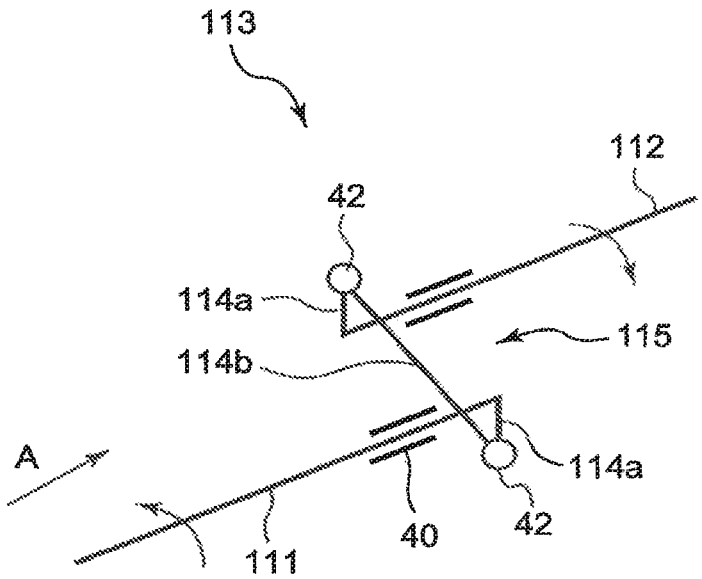
FIG. 8A is a perspective view illustrating a modification of a reversing mechanism included in the support mechanism provided to the carbody support device shown in FIG. 3.
Figure 8B:
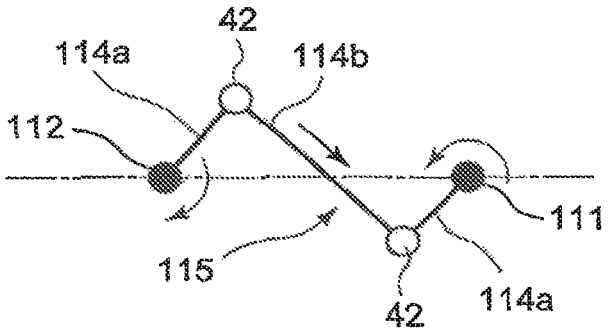
FIG. 8B is a view where the modification shown in FIG. 8A is seen from the A-direction.

Further, in Embodiments 1 and 2, the configuration where the gears are used as the reversing mechanism 113 is described as an example. However, the configuration is not limited to the use of the gears, and may be any other configurations having "reverse" movement functions as described above. For example, since each rotating angle of the first anti rolling bar 111 and the second anti rolling bar 112 is small, the gears may not need to be used. Therefore, as shown in FIGS. 8A and 8B, the reversing mechanism 113 may be comprised of a linkage mechanism 115 coupling respective arms 114*a* to each other which are fixed the first anti rolling bar 111 and the second anti rolling bar 112 by a coupling member 114*b* via joints 42. Note that the arms 114*a* and the coupling member 114*b* are formed, for example, by members made of metal, such as bar steel. Moreover, each arrow shown in FIG. 8B indicates each moving direction of the coupling member 114*b* or the like when the first anti rolling bar 111 is twisted, for example, counter clockwise, and, on the other hand, each moving direction will be reversed when the first anti rolling bar 111 is twisted, for example, clockwise.

Embodiment 3

Next, a carbody support device 103 of Embodiment 3 will be described with reference to FIGS. 9-12. The carbody support device 103 of Embodiment 3 differs from the carbody support device 102 of Embodiment 2 in that the diagonal beam 120 is omitted and, thus it can reduce the weight of the vehicle. Also in the carbody support device 103 of Embodiment 3, the front bogie 11 and the rear bogie 12 are bolsterless bogies, and since the front diagonal beam 121 and the rear diagonal beam 122 are removed, the load of the carbody 20 is transmitted at each of the front bogie 11 and the rear bogie 12 to each bogie frame 13 via the air springs 17 on both sides in the vehicle width directions. That is, the carbody support device 103 concerned is added between typical bolsterless bogies and the carbody.

In the carbody support device 103, the support mechanism 110 having the first anti rolling bar 111, etc. further includes a carbody vertical motion absorber mechanism 140, a coupling piping 150, and a leveling device 160, in addition to the coupling support mechanisms 130 described above. Such support mechanisms are described as a support mechanism 110-3 for convenience of illustration. Further, in the carbody support device 103, the coupling support mechanism 130 has a configuration also comprised of the carbody vertical motion absorber mechanism 140 as will be described below.

The configuration of the support mechanism 110 and the configuration of the coupling support mechanism 130 other than the carbody vertical motion absorber mechanism 140 are configurations already described and, thus, detailed explanation thereof is omitted herein; however, it differs in configuration in terms of the following matters. That is, although in the carbody support device 102 of Embodiment 2 described above, the support mechanism 110 and the coupling support mechanism 130 are disposed on either one of the right side or the left side in the vehicle width directions 21 under the carbody, they are disposed on both sides in Embodiment 3. This is a configuration associated with the removal of the diagonal beam 120. That is, in the carbody support device 103, the carbody 20 may be rolled in connection with air inhalation and exhalation of the air springs 17 on the left and right sides, and therefore, the center of rotation thereof may deviate from the center in the vehicle width directions 21. The both-side arrangement is a configuration in order to compensate the deviation. However, if the center deviation of the center of rotation is negligible, the support mechanism 110 and the coupling support mechanism 130 may be disposed on either one of the right side or the left side, similar to the case of Embodiment 2.

Figure 11:
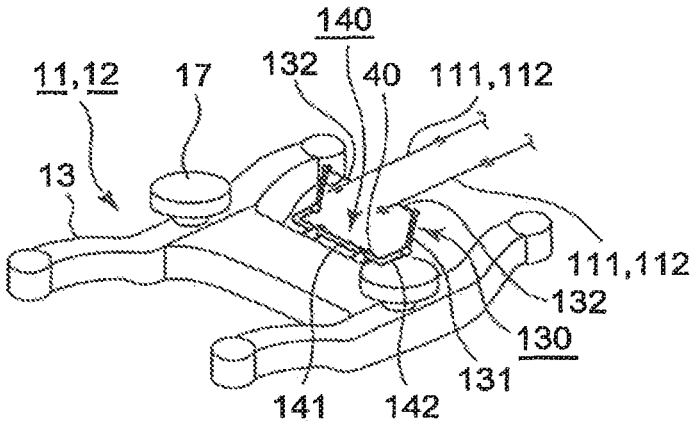
FIG. 11 is a perspective view illustrating a carbody vertical motion absorber mechanism provided to the carbody support device shown in FIG. 9.
Figure 12:
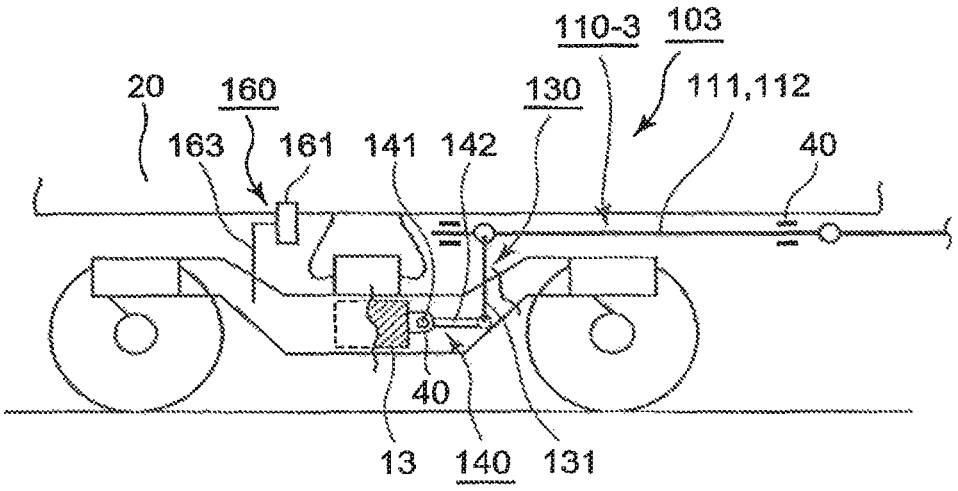
FIG. 12 is a side view illustrating the configuration of the carbody support device shown in FIG. 9.

Since the diagonal beam 120 is not provided, the vertical rigidity of the carbody 20 with respect to each of the bogies 11 and 12 may increase and, thus, riding comfort may be degradated. Thus, the embody support device 103 of this embodiment includes the carbody vertical motion absorber mechanism 140. The carbody vertical motion absorber mechanism 140 includes a bar member 141, for example, such as a torsion bar, made of metal. As shown in FIG. 11, the bar member 141 extends in the vehicle width directions 21 along a cross beam of the bogie frame 13, and is pivotably supported by the bogie frame 13 via bearings 40 about an axis thereof. Each arm 142 is fixed to both ends of the bar member 141, and a channel shape is formed by the bar member 141 and the arms 142. The tip end of each arm 142 is coupled to each coupling member 131 of the coupling support mechanism 130 described above, respectively. Note that, in this embodiment, although the bar member 141 and the arms 142 are formed as separate members, they may be integrally formed.

As described above, the inclining movement of the front bogie 11 and the rear bogie 12 in the vehicle width directions 21 becomes possible to act on the support mechanism 110 described above, by coupling the carbody vertical motion absorber mechanism 140 to the coupling support mechanisms 130.

Thus, in the carbody support device 103, although the coupling support mechanisms 130 are the components also containing the carbody vertical motion absorber mechanism 140, the carbody vertical motion absorber mechanism 140 may not be provided if the degradation of the riding comfort does not cause problems so much. In this case, one end of each of the front side and rear side coupling members 131 of the coupling support mechanism 130 is coupled to each bogie frame 13 of the bogies 11 and 12.

The coupling piping 150 is a piping for communicating between the air springs 17 on both sides in the vehicle width directions in each of the front bogie 11 and the rear bogie 12. A choke member 151, such as a valve, for suppressing and slowing down the air flow between the air springs 17 on both left and right sides may be mounted to the coupling piping 150.

The leveling device 160 is a device for performing air inhalation and exhalation of the air springs 17 on both sides in the vehicle width directions in each of the front bogie 11 and the rear bogie 12 to adjust the height of each air spring 17. The leveling device 160 includes a leveling valve 161, pipings 162 for communicating the leveling valve 161 with the respective left and right air springs 17, and a detecting member 163 coupled to each of the front bogie 11 and the rear bogie 12 in order to detect the height of the carbody 20 with respect to the bogies 11 and 12.

The leveling device 160 thus configured performs known operation in each of the front bogie 11 and the rear bogie 12. Briefly, when a displacement with respect to a prescribed height of the carbody 20 is detected via each detecting member 163 in the front bogie 11 and the rear bogie 12, each leveling valve 161 performs air inhalation or exhalation of the respective left and right air springs 17 to set the carbody 20 to the prescribed height.

The carbody support device 103 of Embodiment 3 configured as described above operates as follows. That is, in each of the front bogie 11 and the rear bogie 12, the two air springs 17 on both left and right sides in the vehicle width directions 21 are communicated with each other through the coupling piping 150, and one leveling valve 161 is provided for the two air springs 17 on both left and right sides, the carbody 20 is supported in the vertical directions with moderate rigidity; however, the carbody 20 is freely rollable.

On the other hand, if the carbody vertical motion absorber mechanism 140, the coupling support mechanisms 130, and the support mechanisms 110 are provided, and these are coupled, the free rolling motion can be prevented especially by the operation of the support mechanisms 110 which has already been described. That is, although the front bogie 11 and the rear bogie 12, and the carbody 20 of the single vehicle are mutually pivotable in the torsional directions (i.e., rotation to the different directions), they have a structure with rigidity in the roll direction (i.e., rotation to the same direction).

Therefore, also by the carbody support device 103 of Embodiment 3, the decreases in wheel load can be prevented at both the front and rear bogies of the single vehicle. Further, in the carbody support device 103, since the diagonal beam 120 is not provided unlike the carbody support device 102 of Embodiment 2, there are advantages that more space can be provided around the bogie under the carbody floor, and the weight of the vehicle can be reduced.

Figure 9:
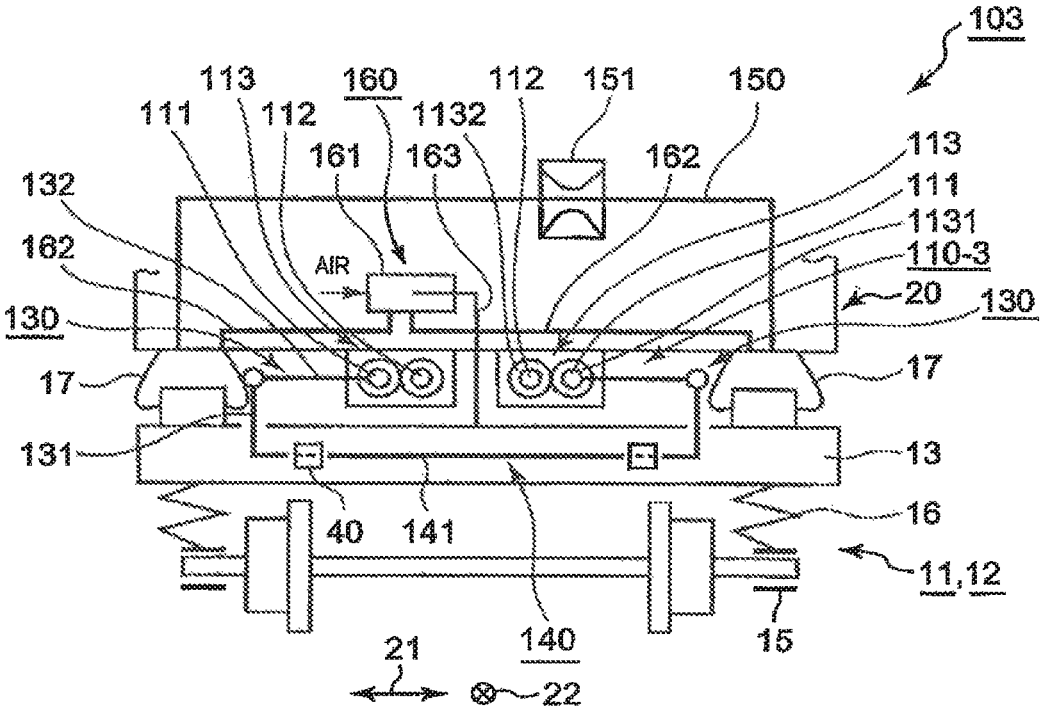
FIG. 9 is an elevational view illustrating a configuration of a carbody support device of Embodiment 3.
Figure 10:
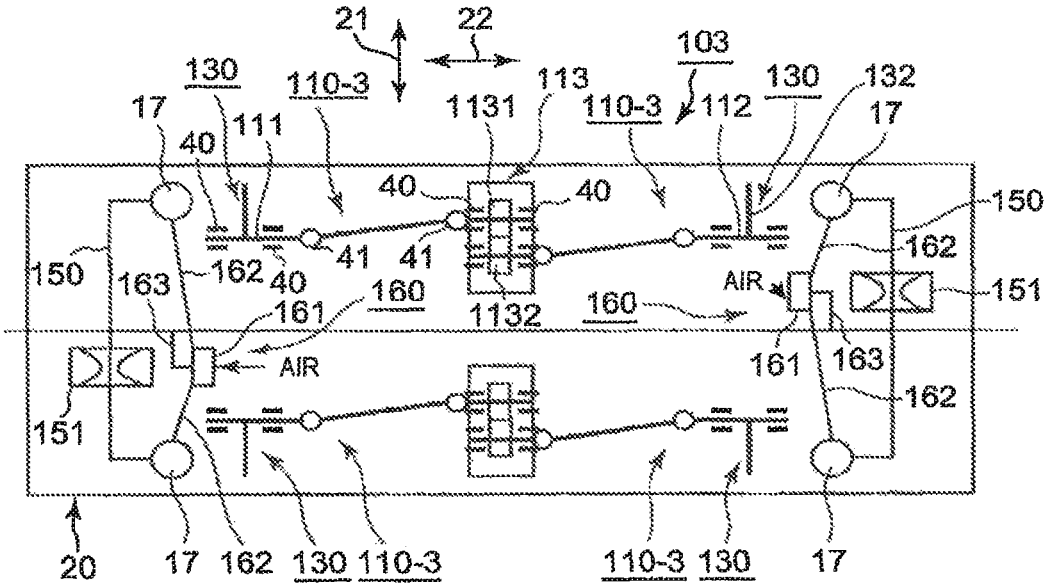
FIG. 10 is a plan view illustrating the configuration of the carbody support device shown in FIG. 9.

Note that, in FIGS. 9 and 10, although the reversing mechanisms 113 in the support mechanism 110 is illustrated in the configurations using the gears, they may be comprised of the linkage mechanisms 115 which are described above with reference to FIGS. 8A and 8B.

Embodiment 4

Next, a carbody support device 104 of Embodiment 4 will be described with reference to FIGS. 13 and 14. Although the carbody support devices of Embodiments 2 and 3 described above describe the case where they are applied to the bolsterless bogies, Embodiment 4 differs in that it is applied to bolstered bogies. The carbody support device 104 has a configuration in which the support mechanisms 110 and the coupling support mechanisms 130 described in Embodiments 2 and 3 are coupled to the bolstered bogies. Further, in the carbody support device 104, the support mechanisms 110 and the coupling support mechanisms 130 are installed on both left and right sides in the vehicle width directions 21 under the carbody, as shown in FIG. 10 of Embodiment 3. Note that since the center pivot of the bolstered bogie has a large clearance and it may cause loosening, the carbody support devices 104 are set on both sides under the carbody in this embodiment, in order to achieve stabilized operation. However, even if it is disposed on one side, the preventive function of decrease in the wheel load can also be realized.

Describing in more detail, in the carbody support device 102 of Embodiment 2 described above, although the configuration having the diagonal beam 120 with respect to the bolsterless bogie is illustrated, a bolster 170 of the bogie is also used as the diagonal beam 120 in the carbody support device 104 of Embodiment 4. Further, in this embodiment, a so-called indirect-mounting bogie is adopted as one example of the bolstered bogie. As shown in FIGS. 13 and 14, the carbody 20 has a center pin 25 which protrudes from the carbody floor at the center in the vehicle width directions 21, at each position corresponding to the front bogie 11 and the rear bogie 12. Further, each of the front bogie 11 and the rear bogie 12 has the bolster 170 provided above each bogie frame 13, and each bolster 170 has a center pivot 171 which engages with the center pin 25. Further, in each of the front bogie 11 and the rear bogie 12, the bolster 170 and the bogie frame 13 are coupled to each other via bolster anchors 18, and the air springs 17 are installed at both ends in the vehicle width directions 21 between the bolsters 170 and the bogie frame 13, respectively.

Note that the center pivot 171 has, for example, a spherical surface, and supports the center pin 25 having a spherical tip end, for example, by a laminated rubber. With such a configuration, the bolster 170 can act as the diagonal beam 120, and the bolster 170 can displace in the roll and yaw directions with respect to the center pin 25.

Further, side bearers 175 are installed between both ends of each bolster 170 in the vehicle width directions 21 and the bottom surface of the carbody corresponding to the both ends, respectively. In this embodiment, each side bearer 175 has a configuration including a pedestal 1751 placed on both ends of the bolster 170, respectively, and a coil spring 1752 which supports the pedestal 1751 from the carbody 20 side. Note that a spring case 1753 which protrudes from the floor bottom surface of the carbody and accommodates the coil spring 1752, and the pedestal 1751 can contact with each other via a clearance, and function as a stopper. This clearance is a distance obtained by adding a margin to the amount of the orbital torsion.

One end of the coupling member 131 of the coupling support mechanism 130 is connected with each bolster 170 thus configured, and the support mechanism 110 is further connected with the coupling support mechanism 130. The coupling support mechanism 130 and the support mechanism 110 have same configurations as those described in Embodiment 2 and, thus, explanation thereof is omitted herein.

The carbody support device 104 of Embodiment 4 configured as described above performs operation in which the explanation related to the diagonal beam 120 (the front diagonal beam 121 and the rear diagonal beam 122) within the explanation of operation of the carbody support device 102 in Embodiment 2 is replaced by the bolster 170. Briefly, for example, within the cant gradually decreasing section as shown in FIG. 1B, the second anti rolling bar 112 of the support mechanism 110 is twisted via the coupling support mechanism 130 on the rear bogie 12 side according to the inclination of the bolster 170 in the rear bogie 12. This twist of the second anti rolling bar 112 twists the first anti rolling bar 111 after the direction is reversed by the reversing mechanism 113, and then acts on the bolster 170 of the front bogie 11 via the coupling support mechanism 130 on the front bogie 11 side, as the rolling force to the outside rail side. This rolling force turns into the resisting force against the floating at the outside rail side of the front bogie 11 and, thus, it can prevent the decreases in wheel load at the outside rail side of the front bogie 11. Further, in the curved section with cant as shown in FIG. 1A, each bolster 170 of both the front bogie 11 and the rear bogie 12 is regulated in rolling to the inside rail side by the operation of the support mechanism 110 via the coupling support mechanism 130, respectively. Thereby, the counterforce against the inclination of the front bogie 11 and the rear bogie 12 to the inside rail side becomes greater.

Thus, also by the carbody support device 104 of Embodiment 4, the decreases in wheel load can be prevented at both the front and rear bogies of the single vehicle. Further, since the diagonal beam 120 is not provided unlike the carbody support device 102 of Embodiment 2, there are advantages that the carbody support device 104 can generate a margin in a space around is the bogie under the carbody floor, and the weight of the vehicle can be reduced.

Figure 13:
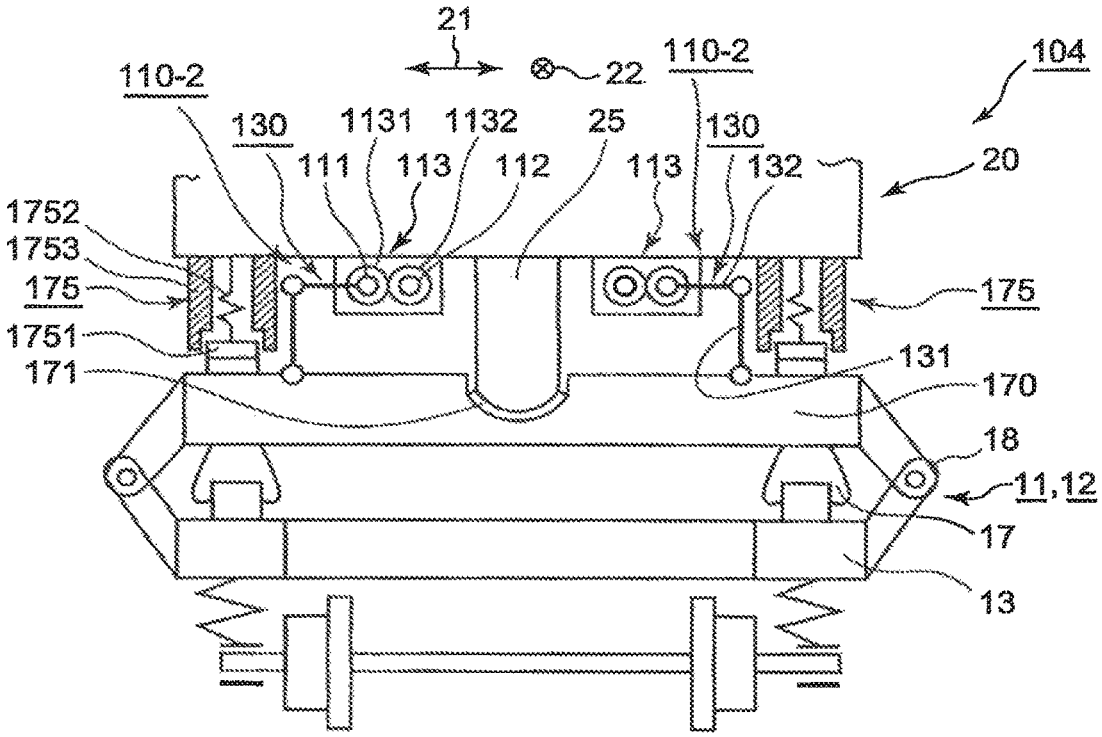
FIG. 13 is an elevational view illustrating a configuration of a carbody support device of Embodiment 4.
Figure 14:
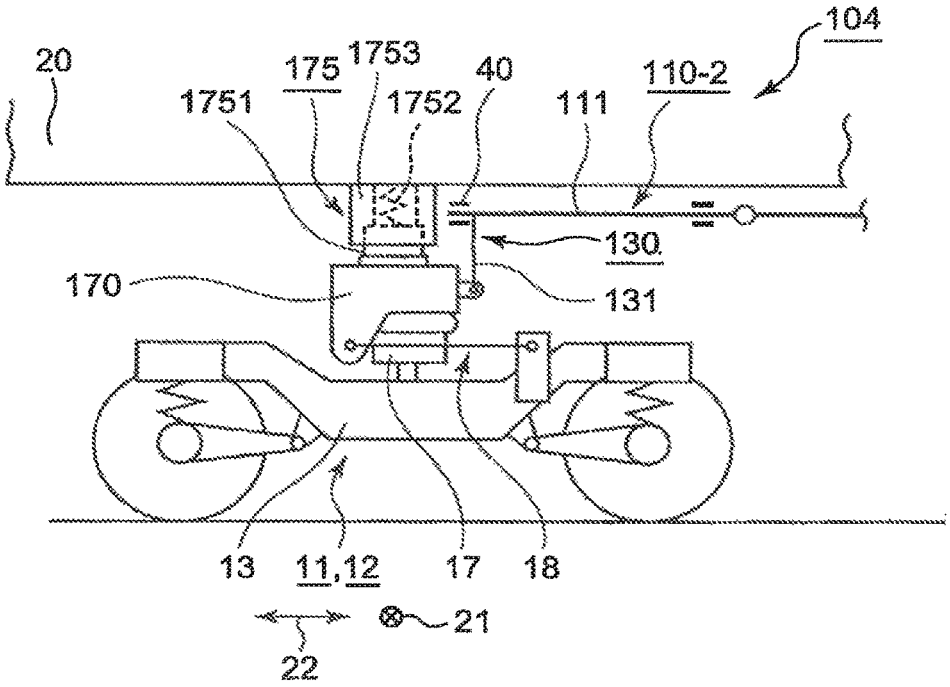
FIG. 14 is a side view illustrating the configuration of the carbody support device shown in FIG. 13.

Note that, in FIG. 13, although the reversing mechanism 113 in the support mechanism 110 is illustrated in the configuration in which the gears are used, it may be comprised of the linkage mechanism 115 described above with reference to FIGS. 8A and 8B.

Embodiment 5

In Embodiments 2-4 described above, the configuration in which the support mechanisms 110 having the first anti rolling bar 111, the second anti rolling bar 112, and the reversing mechanism 113 are used as the support mechanisms provided to the carbody support device is described.

On the other hand, in Embodiment 5 and the following Embodiment 6, support mechanisms have a configuration different from the support mechanisms 110.

Figure 15:
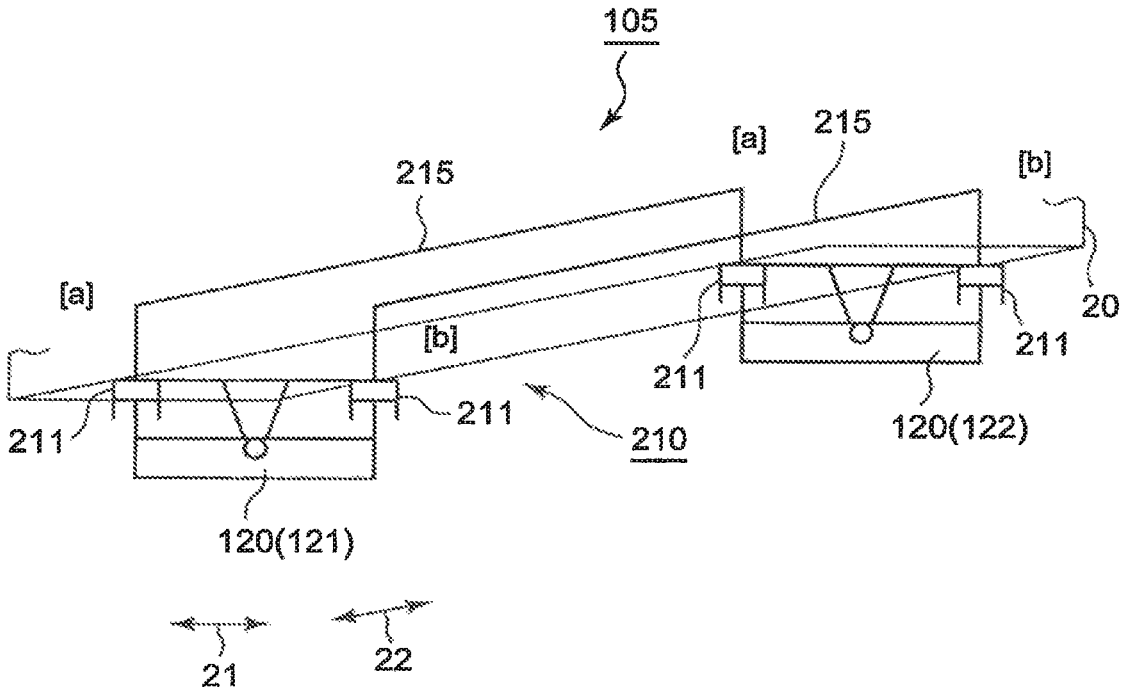
FIG. 15 is a perspective view illustrating a configuration of a carbody support device of Embodiment 5.

First, a carbody support device 105 of Embodiment 5 will be described with reference to FIG. 15. The carbody support device 105 includes support mechanisms 210 having a configuration different from the support mechanisms 110, and the diagonal beams 120. The support mechanisms 210 include hydraulic cylinders 211 and confinement pipings 215. Further, bogies of the railway vehicle provided with the carbody support device 105 are bolsterless bogies.

The diagonal beams 120 are same as the diagonal beams 120 provided to the carbody support device 102 of Embodiment 2, are a front diagonal beam 121 provided corresponding to the front bogie 11 and a rear diagonal beam 122 provided corresponding to the rear bogie 12, and are provided under the carbody. Further, the shape, function, and operation of each of the bogies 11 and 12 are same as those of the diagonal beams 120 of Embodiment 2 and, thus, detailed explanation thereof is omitted herein.

The hydraulic cylinders 211 are cylinders disposed between each of the diagonal beams 121 and 122 and the bottom of the carbody, at total of four locations corresponding to both ends of the front diagonal beam 121 and both ends of the rear diagonal beam 122 in the vehicle width directions 21. A piston rod of each hydraulic cylinder 211 is coupled to both ends of the front diagonal beam 121 and both ends of the rear diagonal beam 122, respectively.

The confinement pipings 215 are pipings extending in vehicle longitudinal directions 22 at both left and right sides of the carbody 20 in the vehicle width directions 21, and are pipings communicating between two hydraulic cylinders 211 disposed on the same side in the vehicle width directions 21 and confining incompressible fluid therein. In this embodiment, mineral oil is used as the incompressible fluid.

The carbody support device 105 configured as described above operates as follows. Each inclination of the front bogie 11 and the rear bogie 12 in the vehicle width directions 21 according to orbital cant acts independently as the rolling force onto the front diagonal beam 121 and the rear diagonal beam 122, respectively. Therefore, for example, in the case of the cant gradually decreasing section as shown in FIG. 1B, the rear diagonal beam 122 of the rear bogie 12 receives the rolling force to the inside rail side (inclination trough side), and this force acts so as to compress the hydraulic cylinder 211 disposed at the outside rail side ("b" side) of the rear bogie 12. Therefore, the fluid in the confinement piping 215 disposed at the outside rail side of the carbody 20 acts on the piston rod of the hydraulic cylinder 211 disposed at the outside rail side ("b" side) of the front bogie 11 to extend the piston rod. Thereby, the rolling force for inclining to the outside rail side acts on the front diagonal beam 121 in the front bogie 11. This force acts on the outside rail side ("b" side) of the front bogie 11 via the air spring 17, and turns into the resisting force against floating of the outside rail side of the front bogie 11. As a result, the decrease in wheel load can be prevented on the outside rail side of the front bogie 11.

On the other hand, at the inside rail side, since the rear diagonal beam 122 receives the rolling force to the inside rail side as described above, the force acts on the piston rod of the hydraulic cylinder 211 disposed at the inside rail side ("a" side) of the rear bogie 12 so as to extend the piston rod. As a result, the fluid in the confinement piping 215 at the inside rail side of the carbody 20 acts on the hydraulic cylinder 211 at the inside rail side ("a" side) of the front bogie 11 to compress the hydraulic cylinder 211. That is, it acts so as not to disturb the rolling of the front diagonal beam 121 in the front bogie 11 to the outside rail side.

Further, in the curved section with cant as shown in FIG. 1A, both the front diagonal beam 121 of the front bogie 11 and the rear diagonal beam 122 of the rear bogie 12 have substantially the same inclination in the same direction. Therefore, the two front and rear hydraulic cylinders 211 disposed at the inside rail side of the carbody 20 and the two front and rear hydraulic cylinders 211 disposed at the outside rail side are neither compressed nor extended, respectively. Therefore, both the front diagonal beam 121 and the rear diagonal beam 122 are regulated in the rolling to the inside rail side ("a" side on the inclination trough side). As a result, the counterforce against the force of the front bogie 11 and the rear bogie 12 inclining to the inside rail side becomes greater.

Thus, the decreases in wheel load can be prevented at both the front and rear bogies of the single vehicle, also by the carbody support device 105 of Embodiment 5. Further, the support mechanism 210 can reduce the number of components and simplify the structure, compared with the support mechanism 110 described above.

Embodiment 6

Next, a carbody support device 106 of Embodiment 6 will be described with reference to FIGS. 16 and 17. The carbody support device 106 corresponds to a modification of the carbody support device 105 of Embodiment 5, and includes the support mechanism 210. As described in Embodiment 5, the support mechanism 210 includes the hydraulic cylinders 211 and the confinement pipings 215, and similarly functions as that of Embodiment 5. However, as will be described below, Embodiment 6 differs in the installation pattern of the hydraulic cylinders 211 due to the difference in the bogie configuration from that of Embodiment 5.

Although the carbody support device 105 of Embodiment 5 described above has the configuration in which it is applied to the railway vehicle provided with the bolsterless bogie, the carbody support device 106 is applied to a railway vehicle having direct mounting bolstered bogies. Therefore, as shown in FIG. 16, in the front bogie 11 and the rear bogie 12, the air springs 17 are provided between each bolster 180 and the floor bottom surface of the carbody at the locations corresponding to both ends of each bolster 180 in the vehicle width directions 21, and a leveling valve 161 for the air spring is provided corresponding to each air spring 17. Further, each bolster 180 has a bolster center pivot (center pin) 181 having a spherical surface at the tip end thereof, which projects at the center of the bottom surface. On the other hand, corresponding to the bolster center pivot 181 of each bolster 180, respective bogie frames 13 of the front bogie 11 and the rear bogie 12 have a bogie center pivot 13*a* formed, for example in a concaved spherical surface shape. This shape is illustrated in the front bogie 11 of FIG. 16. With such bolster center pivots 181 and bogie center pivots 13*a*, each bogie frame 13 can displace in the yaw and roll directions with respect to the carbody 20 and the bolster 180.

Figure 16:
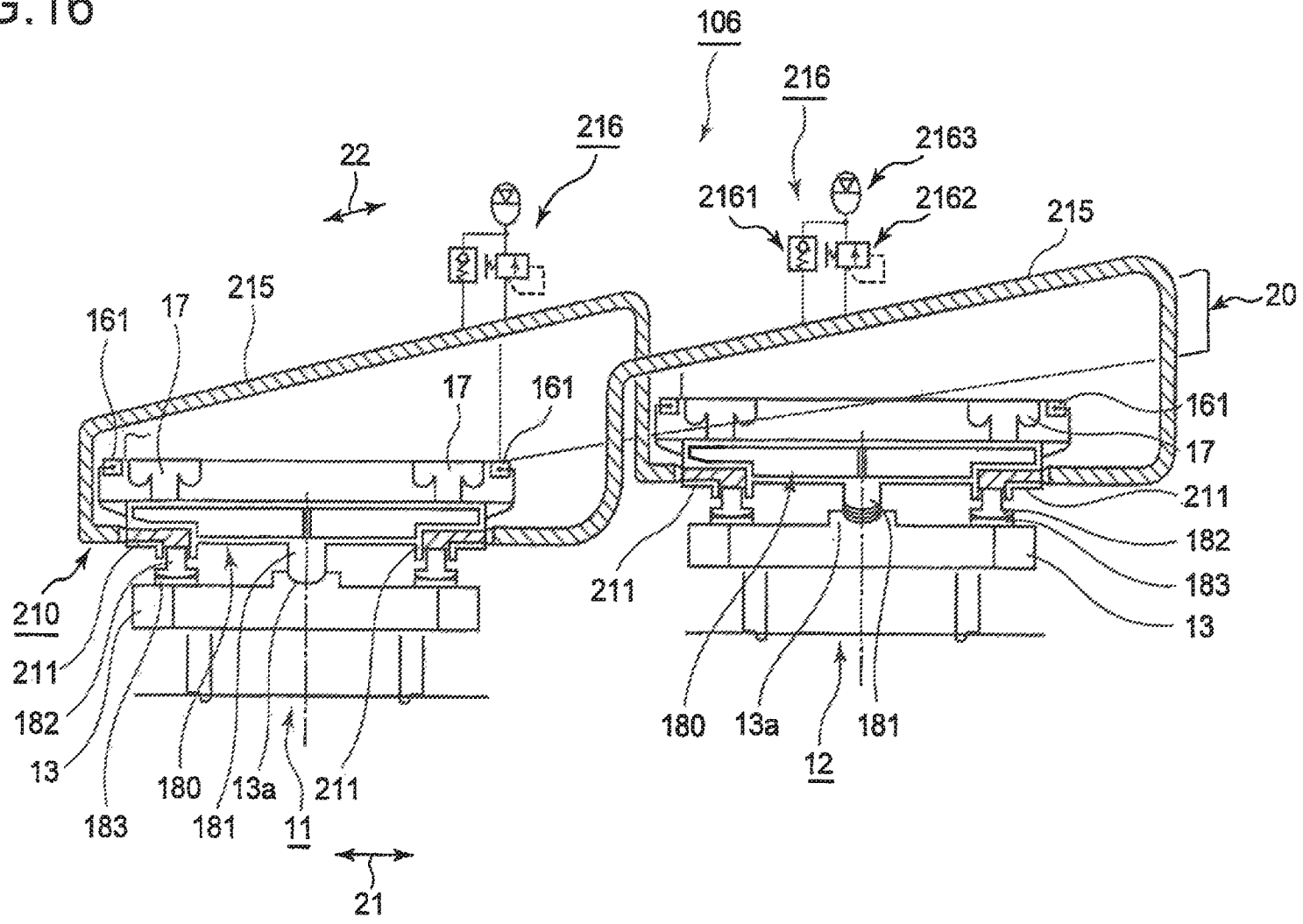
FIG. 16 is a perspective view illustrating a configuration of a carbody support device of Embodiment 6.
Figure 17:
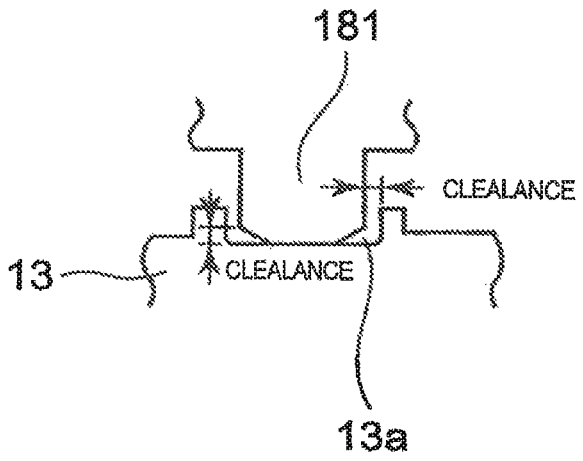
FIG. 17 is a view illustrating a modification of each center pivot in a bolster and a bogie frame provided to the carbody support device shown in FIG. 16.

Note that the configurations of the bolster center pivot 181 and the bogie. center pivot 13*a* are not limited to the spherical surface shape, and they can adopt the configurations, such as using a laminated rubber as illustrated in the rear bogie 12 of FIG. 16, or providing the suitable clearance as shown in FIG. 17. Although different center pivot configurations are illustrated in FIG. 16 for the front bogie 11 and the rear bogie 12 for simplification of the illustration, the same center pivot configuration may of course be adopted in the bogies 11 and 12.

Further, the side bearers 182 are provided to both ends of each bolster 180 in the vehicle width directions 21, respectively, and the hydraulic cylinders 211 is embedded in the bolster 180 corresponding to each side bearer 182. The piston rod of each hydraulic cylinder 211 is disposed via the side bearer 182 so as to oppose to each bogie frame 13 of the front and rear bogies 11 and 12, and a slide plate 183 is mounted to each bogie frame 13 side. Here, the side bearer 182 is not coupled to the slide plate 183.

For such hydraulic cylinders 211, the two hydraulic cylinders 211 disposed on the same side in the vehicle width directions 21 communicate with each other through the confinement piping 215.

The carbody support device 106 configured as described above operates similar to the carbody support device 105 described above. For example, in the cant gradually decreasing section as shown in FIG. 1B, the hydraulic cylinder 211 disposed at the outside rail side ("b" side) in the bolster 180 of the rear bogie 12 receives the compressive force from the bogie frame 13 of the rear bogie 12. Thus, the piston rod of the hydraulic cylinder 211 disposed at the outside rail side of the bolster 180 of the front bogie 11 operates to extend via the fluid inside the confinement piping 215 disposed at the outside rail side of the carbody 20. This operation acts on the outside rail side ("b" side) of the bogie frame 13 of the front bogie 11, and serves as the resisting force against floating of the outside rail side of the front bogie 11. As a result, the decrease in wheel load can be prevented at the outside rail side of the front bogie 11.

On the other hand, at the inside rail side of the rear bogie 12, the force acting on the hydraulic cylinder 211 from the bogie frame 13 becomes weaker compared with the outside rail side. Further, the side bearer 182 at the tip end of the piston rod of the hydraulic cylinder 211 is not coupled to the slide plate 183 on the bogie frame 13 side. Therefore, the fluid inside the confinement piping 215 at the inside rail side of the carbody 20 does not actively act to the hydraulic cylinder 211 at the inside rail side ("a" side) of the front bogie 11.

Further, in the curved section with cant as shown in FIG. 1A, both the bolster 180 of the front bogie 11 and the bolster 180 of the rear bogie 12 have substantially the same inclination in the same direction. Therefore, the two front and rear hydraulic cylinders 211 disposed at the inside rail side of the carbody 20 and the two front and rear hydraulic cylinders 211 disposed at the outside rail side are neither compressed nor extended, respectively. Therefore, both the bolster 180 of the front bogie 11 and the bolster 180 of the rear bogie 12 are regulated in the rolling to the inside rail side ("a" side on the inclination trough side). As a result, the counterforce against the force of the front bogie 11 and the rear bogie 12 inclining to the inside rail side becomes greater.

Thus, also by the carbody support device 106 of Embodiment 6, the decreases in wheel load can be prevented at both the front and rear bogies of the single vehicle. Further, as compared with the carbody support device 105 of Embodiment 5 described above, since the front diagonal beam 121 and the rear diagonal beam 122 can be removed, the carbody support device 106 has advantages that more space can be given around the bogie under the carbody floor, and the weight of the vehicle can be reduced.

Further, in the carbody support device 106 of Embodiment 6 and the carbody support device 105 of Embodiment 5, the support mechanism 210 may further have an oil pressure compensation part 216 for the confinement piping 215. This oil pressure compensation part 216 is a component for setting the oil pressure inside the piping within a prescribed range when an abnormal rise or an abnormal fall occurs to the oil pressure inside the confinement piping 215, and has a configuration in which an accumulator 2163 is connected with the confinement piping 215 via a check valve 2161 and a pressure relief valve 2162. By having such an oil pressure compensation part 216, the operational reliability of the support mechanism 210 can be improved.

Next, in Embodiments 7-10 described below, a carbody support device which has a simpler structure compared with the structures of the support mechanisms in the carbody support devices 101-104 of Embodiments 1-4 described above, and is also applicable, for example, to freight trains, such as container trains and tank trains, will be described. That is, although the reversing mechanism 113 is used as an essential configuration in the carbody support devices 101-104, the carbody support devices of the following Embodiments 7-10 provide the simple structure from which the reversing mechanism 113 is omitted.

Embodiment 7

A carbody support device 107 of Embodiment 7 will be described with reference to FIGS. 18A, 18B and 19A. Note that, in each drawing illustrating the configurations of Embodiments 7-10, each component is illustrated in a simplified form, does not necessarily correspond to actual shape and actual size, and is not intended to limit to the illustrated shape.

First, the configuration around the front bogie 11 and the rear bogie 12 included in the carbody support device 107 will be briefly described. In FIGS. 18A, 18B and 19A, a case where the carbody support device 107 is applied to a freight train is illustrated. Here, each of the front bogie 11 and the rear bogie 12 included in the carbody support device 107 is a bolstered bogie as one example, and a so-called indirect-mounting bogie which was described with reference to FIGS. 13 and 14 is adopted for the example. Each bolster 170 in the front bogie 11 and the rear bogie 12 has the center pivot 171 which engages with the center pin 25 on the carbody 20 side, and is coupled to each bogie frame 13 of the front bogie 11 and the rear bogie 12 by a bolster anchor 18. Further, between the bolster 170 and the bogie frame 13, bolster springs 172 corresponding to one example of the secondary suspension, as well as vertical motion dampers 173 and a swing damper 174 are mounted. Note that the above configuration around the front bogie 11 and the rear bogie 12 is same as the configuration in bogies, for example, for the present container freight trains.

Figure 18A:
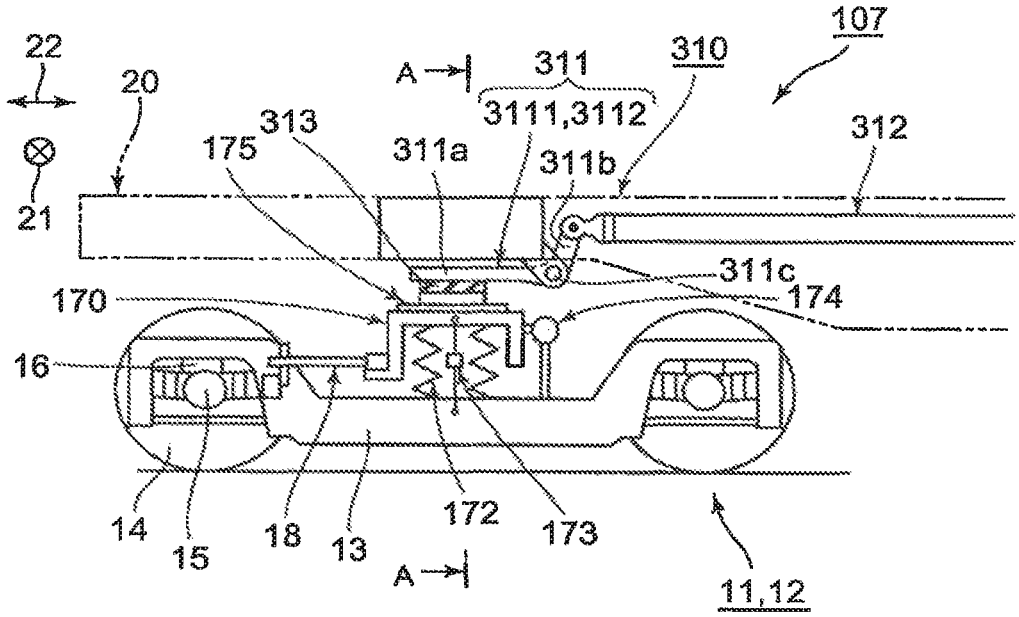
FIG. 18A is a side view illustrating a configuration of a carbody support device of Embodiment 7.
Figure 18B:
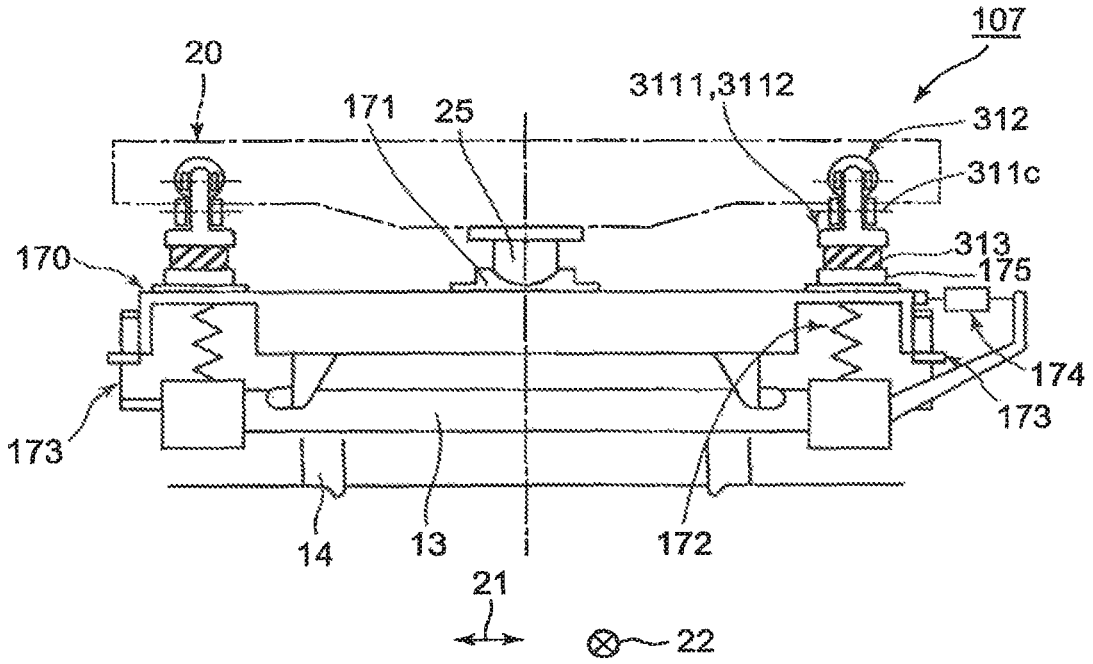
FIG. 18B is a view seen in the arrow A-A direction shown in FIG. 18A.

For convenience, although FIGS. 18A and 18B illustrate only the front bogie 11, since the bogies are symmetrically arranged at the front and rear of the vehicle, the rear bogie 12 also has the same configuration. Therefore, in FIGS. 18A and 18B, components respectively provided for the front bogie 11 and the rear bogie 12 (e.g., the following front side lever members and rear side lever members) are denoted with two reference numerals.

Next, support mechanisms 310 provided to the carbody support device 107 where the front bogie 11 and the rear bogie 12 adopt the above configuration are described. Since the support mechanisms 310 do not have the reversing mechanism 113 described above, it is different from the support mechanisms 110 of Embodiments 2-4, and it is also different from the support mechanisms 210 of Embodiments 5 and 6. A pair of such support mechanisms 310 are installed, for example, under the carbody 20 of the freight train on both sides in the vehicle width directions 21. Each support mechanism 310 includes a front side lever member 3111 provided corresponding to the front bogie 11, a rear side lever member 3112 provided corresponding to the rear bogie 12, and a bar steel member 312 corresponding to one example of the connecting mechanism. Note that the front side lever member 3111 and the rear side lever member 3112 may be generically indicated as a lever member 311.

The front side lever member 3111 and the rear side lever member 3112 are members, for example, each of which is made from a steel plate into an angle shape, and pivots about a fulcrum 311*c* located between one end 311*a* and the other end 311*b* thereof. In this embodiment, the fulcrum 311*c* is supported by the carbody 20. Although the bending angle of the lever member 311 is normally an obtuse angle as illustrated, it may be set suitably according to the vehicle structure, etc., and may be a right angle or an acute angle.

Each of one ends 311*a* of the front side lever member 3111 and the rear side lever member 3112 is located corresponding to the side bearer 175 installed on both ends of each bolster 170 in the vehicle width directions 21, respectively, and presses the front bogie 11 and the rear bogie 12 according to pivoting of the lever member 311. Further, the support mechanism 310 has an elastic member 313 between each one end 311*a* and each side bearer 175, which applies a biasing force to each of the bogies 11 and 12 from each lever member 311. In this embodiment, rubber is used as one example of the elastic member 313. Further, the elastic member 313 thus disposed also functions as a part for adjusting the mounting (installation) between the pair of front and rear support mechanisms 310, and the front bogie 11 and the rear bogie 12, respectively. That is, the installation adjustment is possible by changing the thickness of the rubber in this embodiment. As the result, it becomes possible to appropriately adjust the rigidity in the roll direction (i.e., rotation to the same direction) and in the torsional directions rotation to the different directions) of the front bogie 11 and the rear bogie 12, and the carbody 20 of a single vehicle. Thus, the elastic member 313 can also be used as the member for adjustment, and is not an essential member in the support mechanism 310. Note that since the each bolster 170, together with the bogies 11 and 12, carry out a bogey rotation with respect to the carbody 20 centering on the center pin 25, and the lever member 311 is supported by the carbody 20 in this embodiment, the side bearer 175 and the elastic member 313 are configured to slide via a metal plate which is a so-called slide plate.

Each of the other ends 311*b* of the front side lever member 3111 and the rear side lever member 3112 is coupled to a bar steel member 312 (e.g., a pipe member) which is supported by the carbody 20 and extends in vehicle longitudinal directions 22. Note that since the lever member 311 is pivotable about the fulcrum 311*c*, each of the other ends 311*b* is pivotably mounted with respect to the bar steel member 312. Thus, since each lever member 311 is coupled via the bar steel member 312, and the bar steel member 312 is movable in the vehicle longitudinal directions 22, the front side lever member 3111 and the rear side lever member 3112 move in the same pivoting direction.

Operation of the carbody support device 107 of Embodiment 7 having the support mechanism 310 configured as described above is described below with reference to FIG. 19A. For example, when the vehicle travels in the curved cant gradually decreasing section as shown in FIG. 1B, the bolsters 170 of the front bogie 11 and the rear bogie 12 rotate, due to the orbital torsion, in the opposite roll directions via the bolster springs 172, and they receive the torsional displacement when seen as a single vehicle. Against the torsional displacement, in the support mechanism located forward with respect to the drawing sheet (for convenience, indicated as "310F" in FIG. 19A), the side bearer 175 forward with respect to the drawing sheet in the rear bogie 12 displaces the one end 311*a* of the rear side lever member 3112 upwardly. Therefore, the other end 311*b* via the fulcrum 311*c* of the rear side lever member 3112 is displaced so as to push the bar steel member 312 to the front bogie 11 side. As a result, in the front side lever member 3111 on the front bogie 11 side, it is displaced so that the one end 311*a* of the front side lever member 3111 is pushed downwardly via the fulcrum 311*c*, and the forward side bearer 175 of the front bogie 11 is displaced downwardly.

Figure 19A:
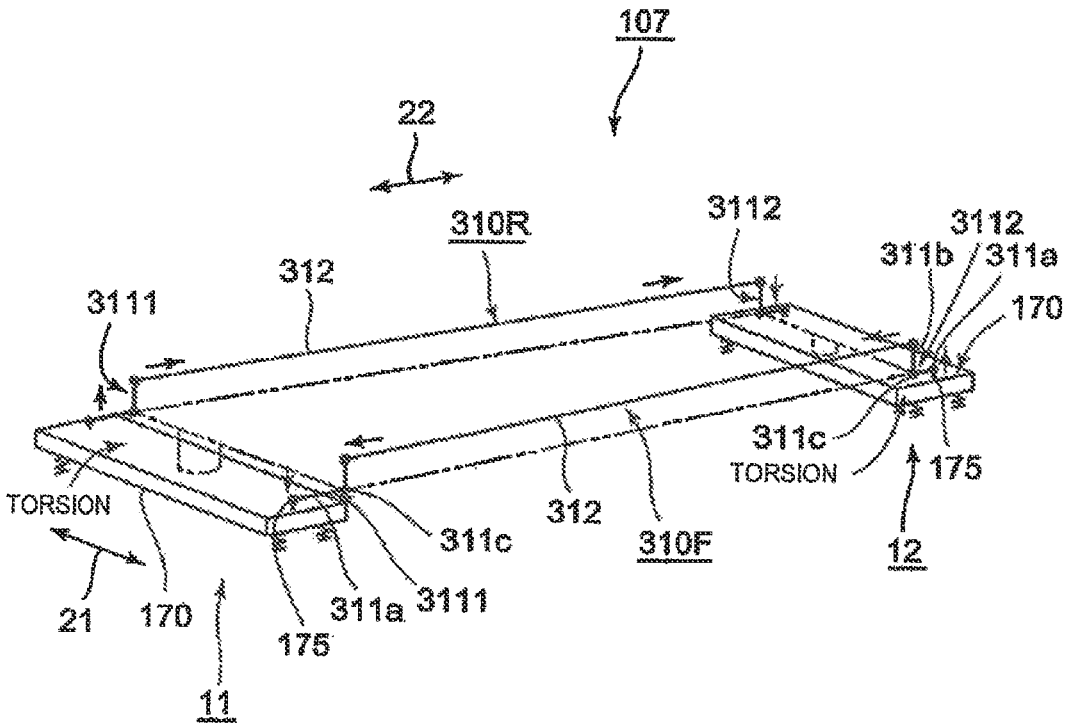
FIG. 19A is a view illustrating operation of the carbody support device shown in FIG. 18A.

This operation displaces oppositely for the support mechanism located rearward with respect to the drawing sheet (for convenience, indicated as "310R" in FIG. 19A). Therefore, the front bogie 11 and the rear bogie 12 carry out the rolling displacements in the opposite direction. For this reason, when seen as a single vehicle, the front bogie 11 and the rear bogie 12 can freely displace with respect to each other in the torsional directions so that they follow each other's motion. As a result, the bolster spring 172 does not bend in the orbit torsional directions, and the variation in the wheel load due to the orbital torsion can be suppressed very small level also in the carbody support device 107 of Embodiment 7.

On the other hand, as shown in FIG. 1A, when the carbody 20 receives a rolling force from forward to rearward with respect to the drawing sheet due to, for example, a centrifugal force caused by the circular curve, etc., in the support mechanism 310R rearward with respect to the drawing sheet in FIG. 19A, each side bearer 175 rearward with respect to the drawing sheet of the front bogie 11 and the rear bogie 12 displaces each one end 311*a* of front side lever member 3111 and the rear side lever member 3112 upwardly, and a compressive force acts on the bar steel member 312. As a result, also in the carbody support device 107 of Embodiment 7, a force acts so that the bolster springs 172 are equally depressed respectively in the front and rear bogies 11 and 12, and the appropriate rigidity can be secured against the rolling.

Here, in the support mechanism 310E on the opposite side, i.e., forward with respect to the drawing sheet in FIG. 19A, since the clearance between the bolster 170 and the carbody 20 becomes larger, the depressing force acting to both the front and rear bogies 11 and 12 may be lost at both the front side lever member 3111 and the rear side lever member 3112. Therefore, in order to prevent occurrence of such an event, in the carbody support device 107 of Embodiment 7, the elastic member 313 is installed between the one end 311*a* of the lever member 311 and the side bearer 175 as described above to apply an appropriate precompression displacement. Thereby, each lever member 311 can press each of the bogies 11 and 12 also in the support mechanism 310F at the time of rolling. Further, since the elastic member 313 presses the side bearer 175 always at an appropriate force in the depressing direction of the bolster 170, it can give appropriate rotational resistance in yaw directions to each of the bogies 11 and 12, and it also becomes possible to prevent an occurrence of meandering motion at the time of high speed traveling. Note that, as described above, the elastic member 313 is not an essential member in the support mechanism 310. That is, since the event, such as the reduction in the bogie depressing force, is an event depending on orbital conditions, etc., the elastic member 313 may not be required.

As described in detail above, also in the carbody support device 107 of Embodiment 7, similar to the carbody support device in each embodiment described above, the front bogie 11 and the rear bogie 12, and the carbody of a single vehicle are mutually pivotable in the torsional directions (i.e., rotation to the different directions); however, they have the structure having rigidity in the roll direction (i.e., rotation to the same direction). Therefore, the decreases in wheel load can be prevented at both the front and rear bogies of the single vehicle.

Further, the carbody support device 107 of Embodiment 7 has peculiar effects that manufacture and maintenances are easy and the manufacturing cost can be reduced because it has the simple structure where the reversing mechanism 113 is omitted from the structures of the support to mechanisms in the carbody support devices 101-104 Embodiments 1-4. Further, resulting from the simple configuration, the carbody support device 107 of Embodiment 7 also has an effect that it is also applicable to freight trains, such as container trains and tank trains, for example. Especially, the freight train bogie which adopts the indirect-mounting carbody supporting structure has peculiar effects that manufacture and maintenances are easy and the manufacturing cost can be reduced because components below the bolster 170 can use existing bogie structures without any changes.

On the other hand, in Embodiment 7, as shown in FIGS. 18A and 19A, although the lever member 311 is arranged so that the other end 311*b* is disposed above the one end 311*a* via the fulcrum 311*c*, the other end 311*b* may be disposed below as a modification of the carbody support device 107. Also in this configuration, the fulcrum 311*c* is supported by the carbody 20 and the lever member 311 is pivotable about the fulcrum 311*c*.

Figure 19B:
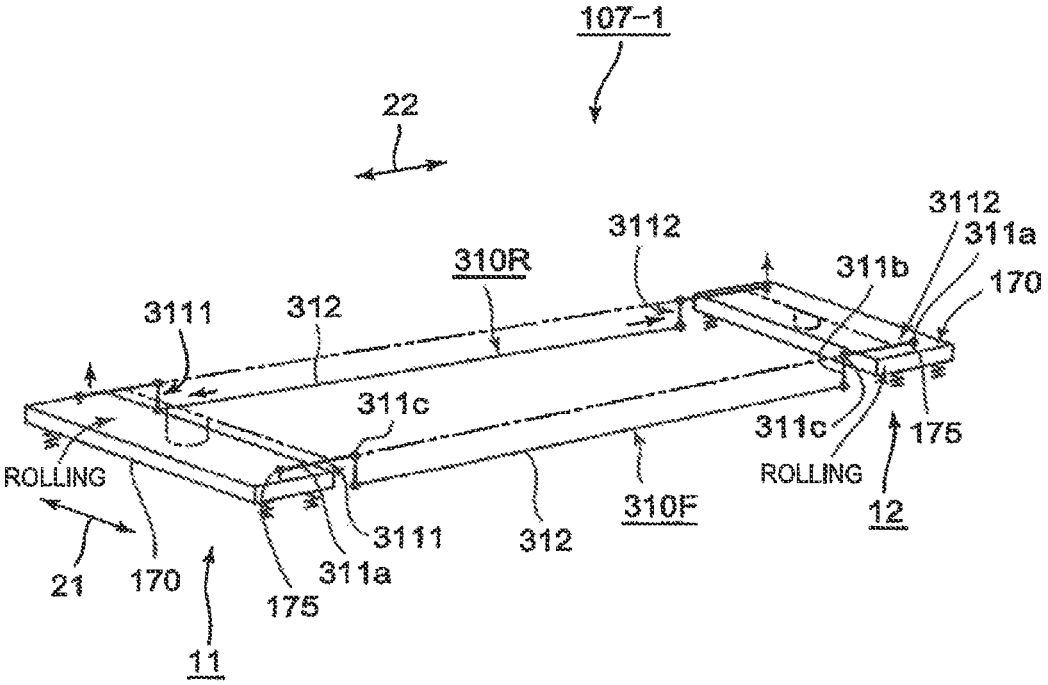
FIG. 19B is a view illustrating operation in a modification of the carbody support device shown in FIG. 18A.

Operation of the carbody support device 107-1 in such modification is described below with reference to FIG. 19B. For example, when the vehicle traveling through the curved cant gradually decreasing section as shown in FIG. 1B, the front side lever member 3111 and the rear side lever member 3112 rotate about the respective fulcrums 311*c* in the same direction, similar to the operation described with reference to FIG. 19A. Therefore, the carbody support device 107-1 functions so that the front bogie 11 and the rear bogie 12 follow and displace with each other in the torsional direction. As a result, also in the carbody support device 107-1, variation in the wheel load due to the orbital torsion can be suppressed very small.

On the other hand, when the vehicle rolls in the same direction, for example, to the inclination trough side as shown in FIG. 1A, as for the carbody support device 107 described above, in the support mechanism 310R rearward with respect to the drawing sheet of FIG. 19A, the compressive force acts on the bar steel member 312 coupling the front side lever member 3111 to the rear side lever member 3112, as described above. On the other hand, as for the carbody support device 107-1 in the modification, in the support mechanism 310R rearward with respect to the drawing sheet shown in FIG. 19B, a tensile force acts on the bar steel member 312 as shown by an arrow. Thus, it becomes unnecessary to take buckling into consideration in the design of the bar steel member 312 and, thus, it becomes possible to design the geometrical moment of inertia smaller. Therefore, high tensile strength material, such as high tensile strength steel or CFRP, for example, may be used for the bar steel member 312 and, thus, a significant weight reduction becomes possible. The stiffness of the bar steel member 312 can be reduced by the ability of the geometrical moment of inertia of the bar steel member 312 to be designed smaller. As a result, in the low-stiffness carbody such as a freight train, when slidably supporting the bar steel member 312 at the central part thereof in the vehicle longitudinal directions 22, it also becomes possible to absorb elastical bending of the carbody due to the elastical bending deformation of the bar steel member 312. Thus, the carbody support device 107-1 in the modification can cause the peculiar effects, in addition to the effects of the carbody support device 107 of Embodiment 7 described above.

Embodiment 8

Figure 20A:
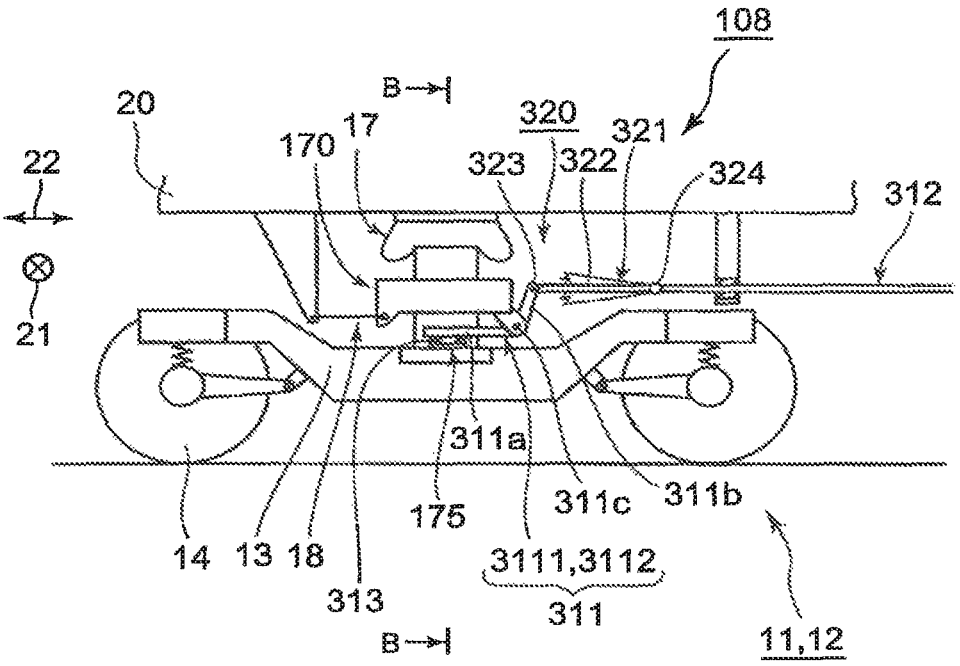
FIG. 20A is a side view illustrating a configuration of a carbody support device of Embodiment 8.
Figure 20B:
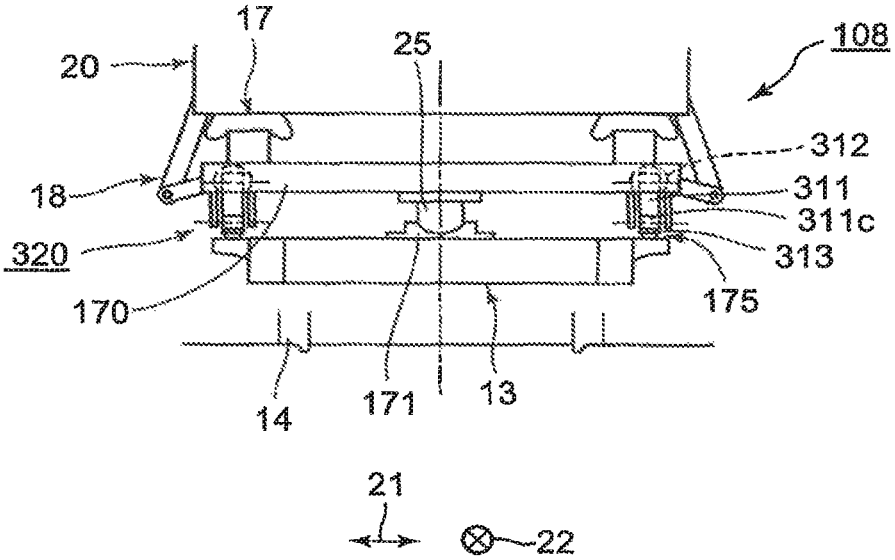
FIG. 20B is a view seen in the arrow B-B direction shown in FIG. 20A.

Next, a carbody support device 108 of Embodiment 8 will be described with reference to FIGS. 20A and 20B. Although the fundamental configuration of the carbody support device 108 in Embodiment 8 is same as the configuration of the carbody support device 107 of Embodiment 7 described above; however, it is different in the following matters. That is, in Embodiment 7, the front and rear bogies 11 and 12 are indirect-mounting bogies, and the other end 311*b* of the lever member 311 is directly coupled to the bar steel member 312. On the other hand, in Embodiment 8, it adopts a configuration in which the front and rear bogies 11 and 12 are direct mounting bogies, and the other end 311*b* of the lever member 311 is coupled to the bar steel member 312 via an absorber mechanism 321.

These different matters are described in detail. The front and rear bogies 11 and 12 are bogies with the bolster 170, and between an upper surface of the bolster 170 and the carbody 20, the air spring 17 corresponding to one example of the secondary suspension is installed on both sides of the bolster 170 in the vehicle width directions 21 to constitute the direct mounting bogie. Therefore, the clearance between the bolster 170 and the carbody 20 varies in vertical directions. Further, a support mechanism 320 in the carbody support device 108 of Embodiment 8 corresponding to the support mechanism 310 in the carbody support device 107 includes the lever member 311, the bar steel member 312, and the elastic member 313 which were described above, and further includes the absorber mechanism 321. Further, the lever member 311 is supported by the carbody 20 so as to be pivotable about the fulcrum 311*c* in the carbody support device 107; however, on the other hand, the lever member 311 is supported by the bolster 170 so as to be pivotable about the fulcrum 311*c* in the carbody support device 108. Meanwhile, the bar steel member 312 is supported by the carbody 20 so as to be movable in the vehicle longitudinal directions 22 also in the carbody support device 108.

The absorber mechanism 321 is a mechanism for absorbing the vertical displacement of the bolster 170 and the carbody 20, between the other end 311*b* of the lever member 311 and the bar steel member 312, and as one example thereof, in this embodiment, it adopts a configuration in which one end of a steel bar 322 is coupled to the other end 311*b* of the lever member 311 via hearings 323, and the other end of the bar 322 is coupled to an end of the bar steel member 312, for example, via a universal joint 324, such as a spherical joint. Of course, the configuration of the absorber mechanism 321 is not intended to limit to the configuration of this example but can adopt any displacement absorbable configurations which can be perceived by the person skilled in the art.

Since the fundamental configuration of the carbody support device 108 of Embodiment 8 configured as described above is same as the configuration of the carbody support device 107, it performs the same operations as the operations described above of the carbody support device 107. Therefore, also in the carbody support device 108 of Embodiment 8, it can cause the same effects as the carbody support device 107 of Embodiment 7, and the decreases in wheel load can be prevented at both the front and rear bogies of the single vehicle. Further, since the absorber mechanism 321 is provided, the displacement between the bolster 170 and the carbody 20 in the vertical directions can be absorbed, and appropriate operations of the support mechanism 320 can be guaranteed in the direct mounting bogie.

Embodiment 9

Figure 21:
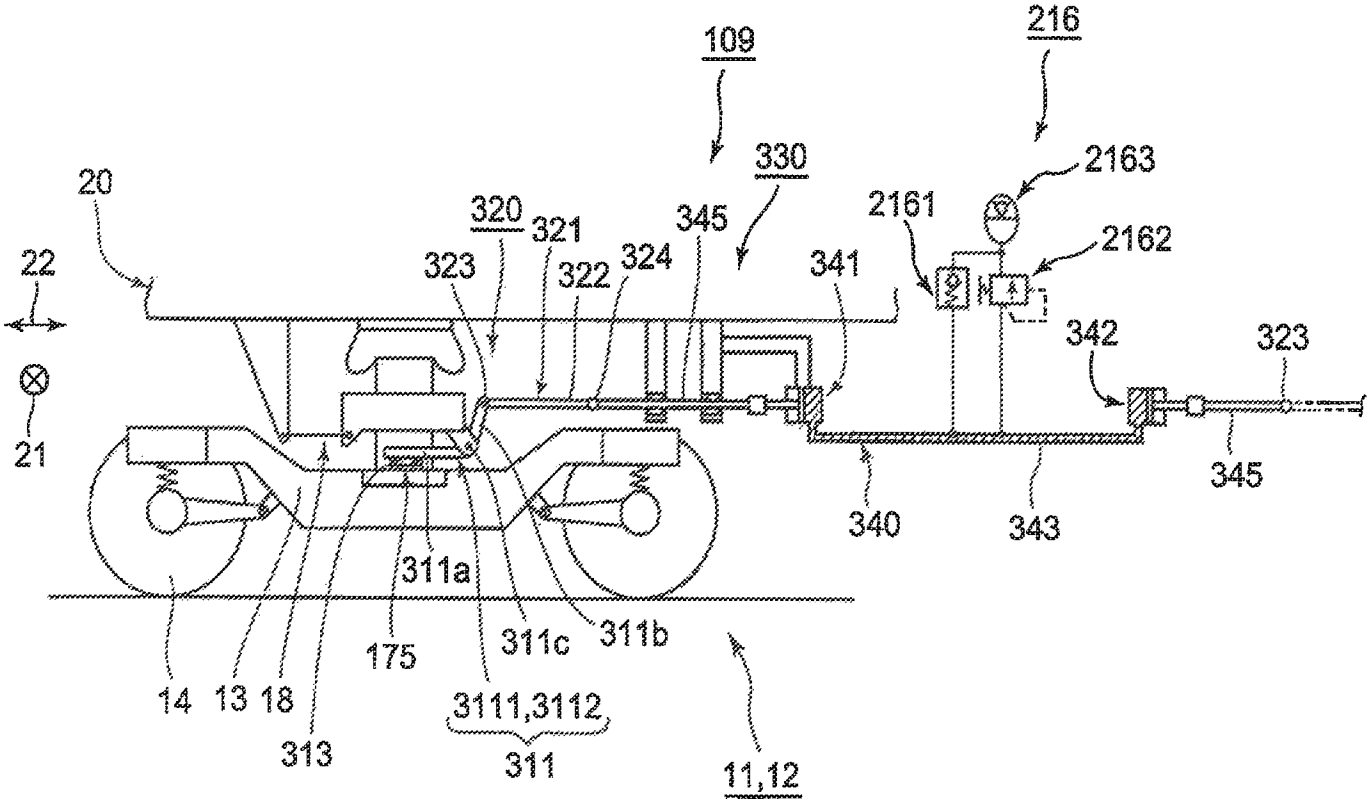
FIG. 21 is a side view illustrating a configuration of a carbody support device of Embodiment 9.

Next, a carbody support device 109 of Embodiment 9 will be is described with reference to FIG. 21. The carbody support device 109 in Embodiment 9 includes a support mechanism 330 having a different connecting mechanism from the connecting mechanism which is the bar steel member 312 in Embodiments 7 and 8 as one example. The support mechanism 330 includes a front side lever member 3111, a rear side lever member 3112, and a hydraulic circuit 340 corresponding to the connecting mechanism, and also includes an elastic member 313 and an absorber mechanism 321. Here, the front side lever member 3111, the rear side lever member 3112, the elastic member 313, and the absorber mechanism 321 are same in the configuration described in Embodiments 7 and 8 and, thus, explanation thereof is omitted in Embodiment 9. Further, the front and rear bogies 11 and 12 included in the carbody support device 109 of Embodiment 9 are direct mounting bogies with a bolster, and are same in the configuration described in Embodiment 8. Thus, explanation thereof is omitted herein also regarding the configuration around the front and rear bogies 11 and 12. Therefore, below, the hydraulic circuit 340 in the support mechanism 330 is described in detail.

The hydraulic circuit 340 corresponding to one example of the connecting mechanism includes a front side hydraulic cylinder 341 installed on the front bogie 11 side, a rear side hydraulic cylinder 342 installed on the rear bogie 12 side, and confinement piping 343 communicating between the hydraulic cylinders 341 and 342. The front side hydraulic cylinder 341 and the rear side hydraulic cylinder 342 are generally-used hydraulic cylinders and are supported by the carbody 20, in which a piston moves inside one cylinder so that a piston inside the other cylinder is moved in the opposite direction by, for example, mineral oil which is incompressible medium inside the confinement piping 343. Further, a piston rod of the front side hydraulic cylinder 341 is oriented in vehicle longitudinal directions 22, and it is connected with one end of a steel bar 345 via a joint. Similarly, the bar 345 extending in the vehicle longitudinal directions 22 is supported by the carbody 20 via bearings so as to be movable in the vehicle longitudinal directions 22, and it is coupled at the other end to the universal joint 324 of the absorber mechanism 321. By configured as described above, the piston inside the front side hydraulic cylinder 341 can be moved associated with pivoting operation about the fulcrum 311*c* of the front side lever member 3111. The rear side hydraulic cylinder 342 is also configured similar to the front side hydraulic cylinder 341, and the piston inside the rear side hydraulic cylinder 342 can be moved associated with pivoting operation of the rear side lever member 3112.

Therefore, according to the pivoting operation at least one of the front side lever member 3111 and the rear side lever member 3112, pivoting operation of at least one of the other of the front side lever members 3111 and the rear side lever members 3112 can be caused via the front side absorber mechanism 321 and the bar 345, the front side hydraulic cylinder 341, the confinement piping 343, the rear side absorber mechanism 321 and the bar 345, and the rear side hydraulic cylinder 342.

Further, in confinement piping 343, the oil pressure compensation part 216 described for the carbody support device 106 of Embodiment 6 can be provided as a component for setting the oil pressure inside the piping within a predetermined range when the oil pressure inside the confinement piping 343 increases or decreases abnormally. The oil pressure compensation part 216 includes the check valve 2161, the pressure relief valve 2162, and the accumulator 2163.

Operation of the carbody support device 109 in Embodiment 9 configured as described above is described below. When the vehicle travels through the curved cant gradually decreasing section having the orbital torsion as shown, for example, in FIG. 1B, the vehicle receives a torsional displacement if it is seen as a single vehicle as already described. Against the torsional displacement, as described with reference to FIG. 19A in Embodiment 7, forward with respect to the drawing sheet of the rear bogie 12, one end 311*a* of the rear side lever member 3112 is displaced upwardly, and the rear side lever member 3112 pivots about the fulcrum 311*c*. Thus, the piston of the rear side hydraulic cylinder 342 is driven via the rear side absorber mechanism 321 and the bar 345 in a direction in which the piston is inserted into the cylinder, and the piston of the front side hydraulic cylinder 341 is driven outwardly from the cylinder by the hydraulic operation through the confinement piping 343. This piston operation of the front side hydraulic cylinder 341 pivots the front side lever member 3111 via the front side bar 345 and the absorber mechanism 321, and one end 311*a* of the front side lever member 3111 is displaced so that it is depressed downwardly. This operation is displaced in the opposite direction for the support mechanism 340 located rearward with respect to the drawing sheet. Therefore, the front bogie 11 and the rear bogie 12 displace in opposite roll directions. For this reason, as seen as a single vehicle, the front bogie 11 and the rear bogie 12 freely displace with respect to each other in the torsional directions so that they follow each other's motion. Thus, also in the carbody support device 109 of Embodiment 9, the variation in the wheel load due to the orbital torsion can be suppressed very small.

As shown in FIG. 1A, when the carbody 20 receives the rolling force rearward with respect to the drawing sheet, at the support mechanism 340 located rearward with respect to the drawing sheet, each side bearer 175 rearward with respect to the drawing sheet of both the front bogie 11 and the rear bogie 12 displaces each one end 311*a* of the front side lever member 3111 and the rear side lever member 3112 upward, respectively. Therefore, although each piston is driven in the direction in which it is inserted into the cylinder in the front side hydraulic cylinder 341 and the rear side hydraulic cylinder 342, the drive is prohibited by the incompressible mineral oil inside the confinement piping 343. As a result, also in the carbody support device 109 of Embodiment 9, the force acts on each of the front and rear bogies 11 and 12 so that the bolster springs 172 are equally depressed and, thus, appropriate rigidity can be secured against the rolling. Further, forward with respect to the drawing sheet of FIG. 1A of the front bogie 11 and the rear bogie 12, as already described, the front side lever member 3111 and the rear side lever member 3112 can press each of the bogies 11 and 12 by the appropriate precompression displacement caused by the elastic member 313.

As described in detail above, also in the carbody support device 109 of Embodiment 9, although the front bogie 11 and the rear bogie 12, and the carbody of the single vehicle are mutually pivotable in the torsional directions (i.e., rotation to the different directions), similar to the carbody support device in each embodiment described above, it has the structure having rigidity in the roll direction (i.e., rotation to the same direction). Therefore, the decrease in wheel load can be prevented at both the front and rear bogies of the single vehicle.

Further, in the carbody support device 109 of Embodiment 9, the hydraulic circuit 340 including the front side hydraulic cylinder 341, the rear side hydraulic cylinder 342, the confinement piping 343, and the bar 345 are loaded in the carbody 20, and it transmits the displacement of each of the bogies 11 and 12 via the absorber mechanism 321. By configured as described above, traveling vibration which acts on the hydraulic circuit 340, especially the traveling vibration from the front bogie 11 and the rear bogie 12 can be significantly reduced and, thus, the reliability of the hydraulic circuit 340 can be improved.

Note that, in Embodiments 7 and 8, instead of the bar steel member 312 as one example of the connecting mechanism, the configuration regarding the hydraulic circuit 340 provided to the carbody support device 109 of Embodiment 9 may be installed.

Embodiment 10

Figure 22:
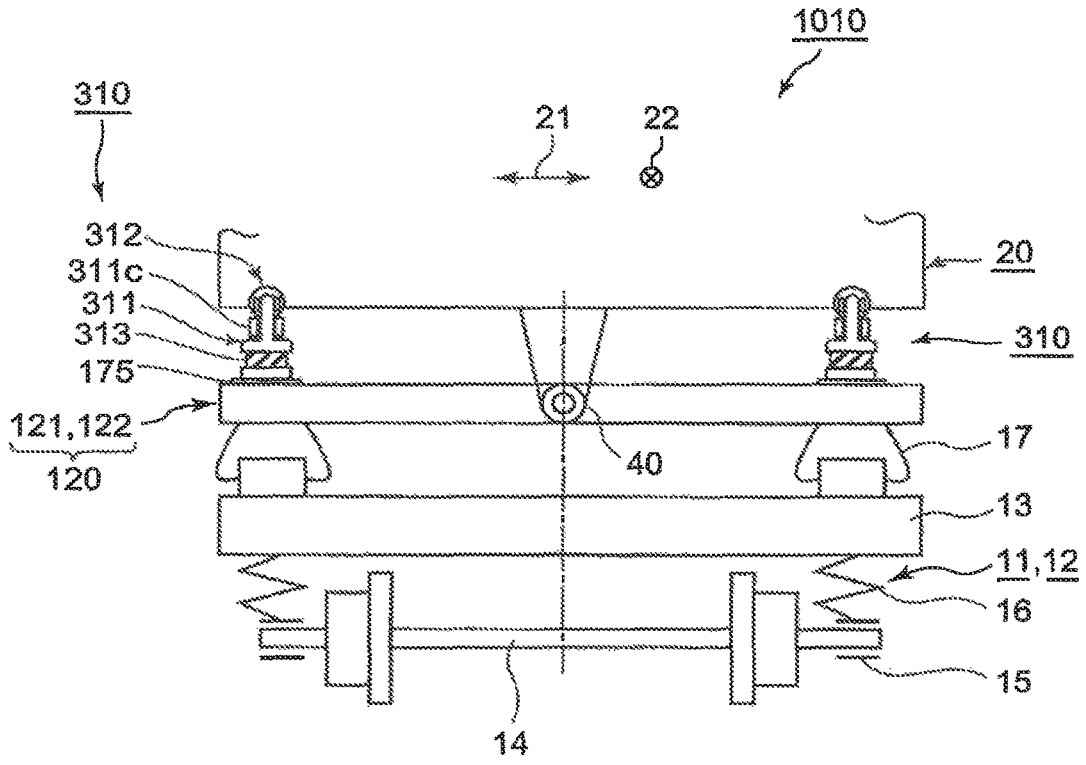
FIG. 22 is a side view illustrating a configuration of a carbody support device of Embodiment 10.

Next, a carbody support device of Embodiment 10 will be described with reference to FIG. 22. In a carbody support device 1010 of Embodiment 10, the front bogie 11 and the rear bogie 12 are bolsterless bogies, and the support device is of a form in which the configurations of Embodiments 7-9 are applied to the bolsterless bogies. The front bogie 11 and the rear bogie 12 which are included in such a carbody support device 1010 and are bolsterless bogies include the bogie frame 13, the wheel set 14, the journal box 15, the axle spring 16, and the air spring 17, respectively, as described in, for example, Embodiment 2. The air spring 17 is installed on the upper surface of the bogie frame 13 on both sides in the vehicle width directions 21, respectively. Such a carbody support device 1010 further includes the diagonal beams 120, and the support mechanisms 310, for example, described in Embodiment 7. Here, the diagonal beams 120 are the front diagonal beam 121 for the front bogie 11 and the rear diagonal beam 122 for the rear bogie 12, which are described in Embodiment 2. Note that the diagonal beam 120 has the through-hole 128 already described in Embodiment 2. The support mechanisms 310 are installed in the diagonal beams 120 on both sides in the vehicle width directions 21. Note that the support mechanism 310 may have the absorber mechanism 321 as described above, and the hydraulic circuit 340 may be installed instead of the bar steel member 312. Further, the lever member 311 may be disposed so that the other end 311*b* of the lever member 311 is oriented downwardly, similar to the carbody support device 107-1 in the modification of Embodiment 7.

Operation of the carbody support device 1010 thus configured will be briefly described. Each diagonal beam 120 displaces in the roll direction about the bearings 40 according to the orbital cant. On the other hand, the support mechanism 310 acts on the front bogie 11 and the rear bogie 12, and the carbody of the single vehicle as described in Embodiment 7 so that they can mutually pivotable in the torsional directions (i.e., rotation to the different directions), and so that they have rigidity in the roll direction (i.e., rotation to the same direction). Therefore, the decrease in wheel load can be prevented at both the front and rear bogies of the single vehicle. Further, appropriate rigidity is securable also against the rolling in the vehicle width directions 21.

Embodiment 11

Figure 23:
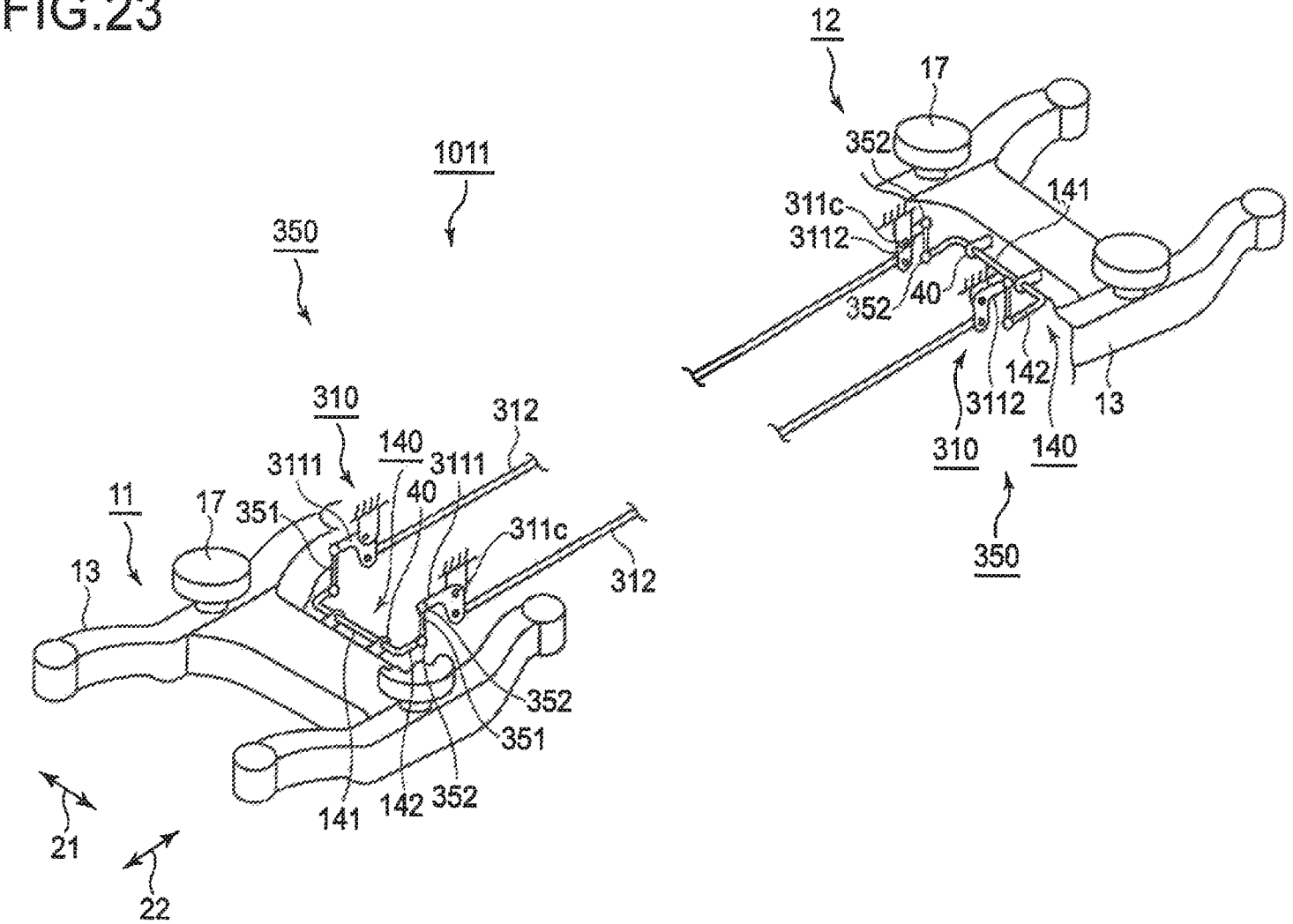
FIG. 23 is a perspective view illustrating a configuration of a carbody support device of Embodiment 11.
Figure 24:
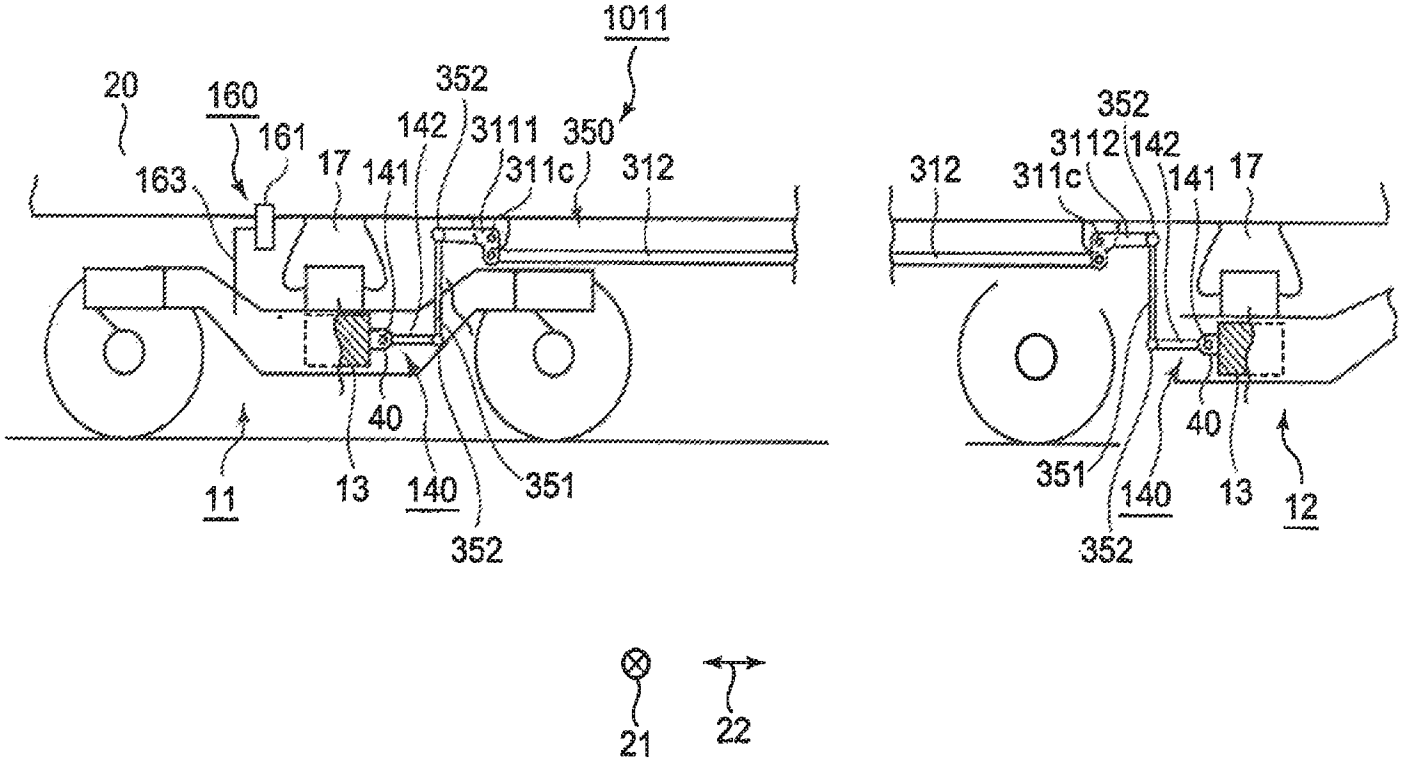
FIG. 24 is a side view of the carbody support device shown in FIG. 23.
Figure 25:
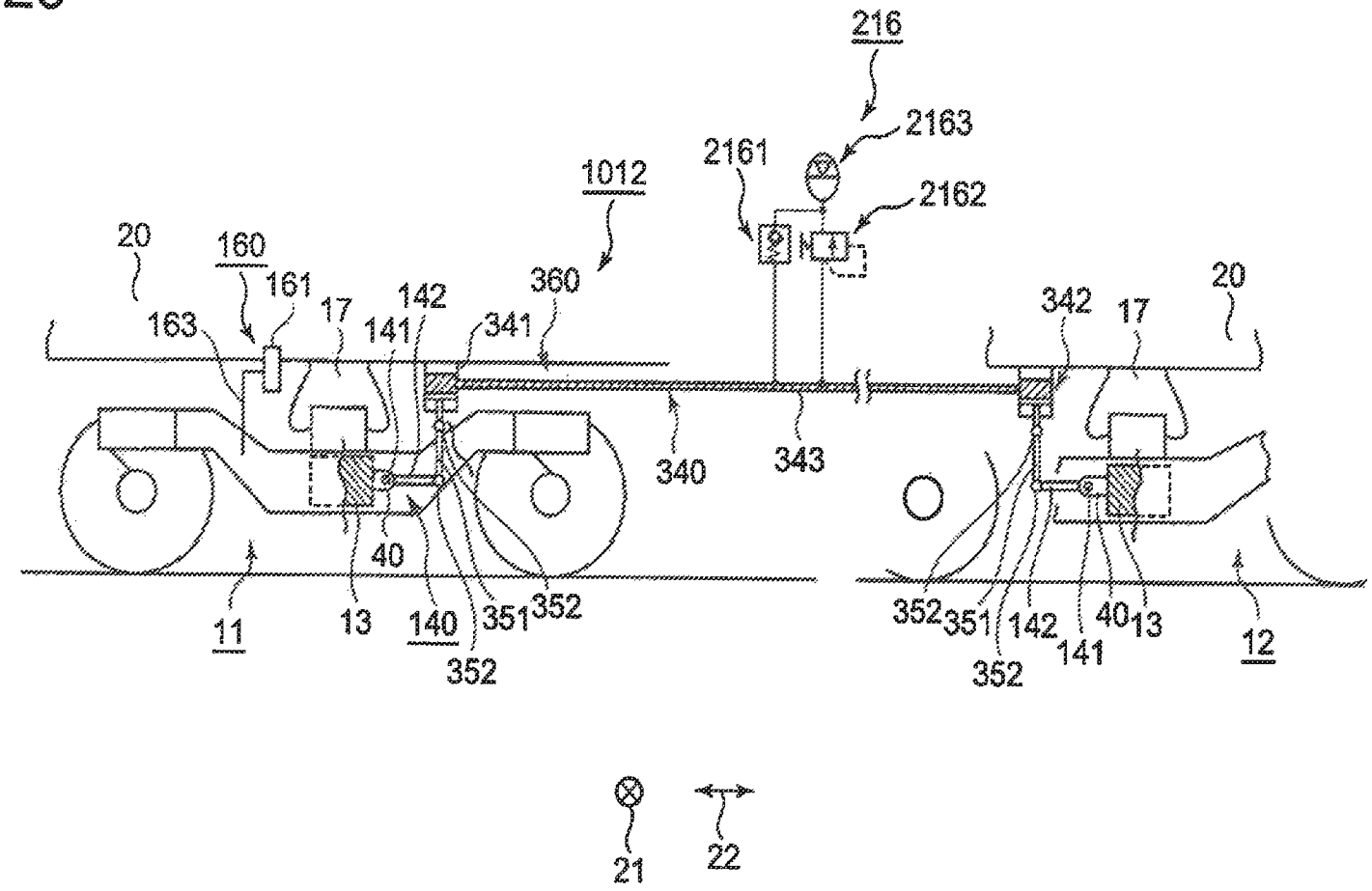
FIG. 25 is a side view in a modification of the carbody support device shown in FIG. 23.
Figure 26:
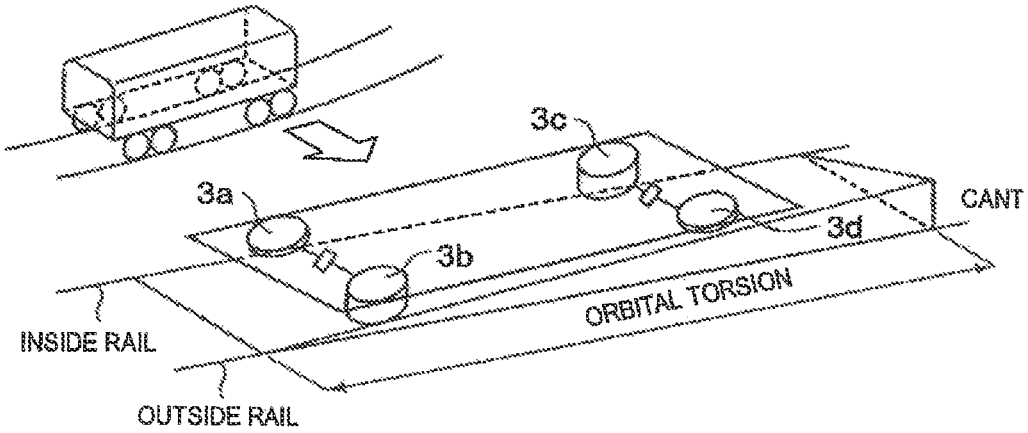
FIG. 26 is a perspective view illustrating a state when a conventional railway vehicle travels through a cant gradually decreasing section.

Next, a carbody support device of Embodiment 11 will be described with reference to FIGS. 23-25. Note that, also in FIGS. 23-25, each component indicates one example, is illustrated in a simplified form, does not necessarily correspond to actual shape and size, and is not intended to limit to the illustrated shape.

The carbody support device 1011 in Embodiment 11 is mainly adoptable to a coach train, is a carbody support device applied to a bolsterless bogie, and has a support mechanism 350. The support mechanism 350 corresponds to the modification of the support mechanism 310 of simple structure which is described in Embodiment 7 and from which the reversing mechanism 113 is omitted. That is, the support mechanism 350 provided to the carbody support device 1011 includes a configuration of the front bogie 11 and the rear bogie 12 which are bolsterless bogies, in which the carbody vertical motion absorber mechanism 140 described in Embodiment 3 and the support mechanism 310 of Embodiment 7 are combined. Although the to carbody support device 1010 of Embodiment 10 described above is also a carbody support device for a bolsterless bogie, the diagonal beam 120 is not used in the carbody support device 1011, as compared with the carbody support device 1010. Therefore, the front bogie 11 and the rear bogie 12 are typical bolsterless bogies, and the air springs 17 are provided between the m bogie frame 13 and the carbody 20 on both sides in the vehicle width directions 21. The left and right air springs 17 mutually communicate with each other through the coupling piping 150 to which the leveling device 160 is connected, as described in Embodiment 3.

The support mechanism 350 is described below. The support mechanism 350 includes the carbody vertical motion absorber mechanism 140 as described above and the support mechanism 310, and further includes the coupling member 351 coupling these.

The carbody vertical motion absorber mechanism 140 is a mechanism already described in Embodiment 3 and, thus, it will be briefly described here. That is, the carbody vertical motion absorber mechanism 140 is installed in each bogie frame 13 of the front bogie 11 and the rear bogie 12, respectively, and has a bar member 141 and arms 142. The bar member 141 is oriented in the vehicle width directions 21, and the arm 142 is disposed at both ends, respectively. The bar member 141 and the arms 142 form the channel shape. Further, each bar member 141 is pivotably supported by each bogie frame 13 of the front bogie 11 and the rear bogie 12 via the bearings 40. The coupling member 351 formed from a member, for example, made of metal, such as bar steel, is coupled to the tip end of each arm 142 at both ends of the bar member 141 via a universal joint 352, respectively. Note that the carbody vertical motion absorber mechanism 140 and the coupling member 351 which are thus configured correspond to the front side coupling support mechanism in the front bogie 11 and the rear side coupling support mechanism in the rear bogie 12, respectively. As described in Embodiment 3, the carbody vertical motion absorber mechanism 140 is not an essential configuration, and it can be omitted if the degradation of riding comfort does not cause a problem. If the carbody vertical motion absorber mechanism 140 is not provided, one end of each coupling member 351 disposed on both sides in the vehicle width directions 21 is coupled to each bogie frame 13 of the front bogie 11 and the rear bogie 12.

The support mechanism 310 is a mechanism already described in Embodiment 7 and, thus, it will be briefly described here. That is, a pair of support mechanisms 310 are installed on both sides in the vehicle width directions 21 under the carbody 20, and each support mechanism 310 includes the front side lever member 3111, the rear side lever member 3112, and the connecting mechanism. Here, as one example of the connecting mechanism, the bar steel member 312 (for example, a pipe member) is adopted. Note that Embodiment 7 and Embodiment 11 are different in the connecting configuration of the front side lever member 3111 and the rear side lever member 3112 with the front bogie 11 and the rear bogie 12. Therefore, the shapes of the front side lever member 3111 and the rear side lever member 3112 in Embodiment 11 are slightly different from those of Embodiment 7. However, similar to the case of Embodiment 7, the front side lever member 3111 and the rear side lever member 3112 in Embodiment 11 also have a substantially L-shape and, thus, the function thereof is also the same. Further, the font side lever member 3111 and the rear side lever member 3112 are generically referred to as the lever member 311, as described above. Further, the fulcrum 311*c* of each lever member 311 is supported by the carbody 20, and each lever member 311 is pivotable about the fulcrum 311*c*.

At the front bogie 11 side, one end of each front side lever member 3111 disposed on both sides in the vehicle width directions 21 is connected with the other end of each coupling member 351 via the universal joint 352. Further, at the rear bogie 12 side, one end of each rear side lever member 3112 disposed on both sides in the vehicle width directions 21 is also coupled to the other end of each coupling member 351 via the universal joint 352. Each of the other ends of the front side lever member 3111 and the rear side lever member 3112 disposed at one side in the vehicle width directions 21 is pivotably mounted to the single bar steel member 312. Each of the other ends of the front side lever member 3111 and the rear side lever member 3112 disposed at the other side in the vehicle width directions 21 is also pivotably mounted to the single bar steel member 312.

Operation of the carbody support device 1011 having the support mechanism 350 configured as described above will be briefly described below. As already described in Embodiment 3, the carbody 20 is vertically supported with moderate rigidity via the air springs 17 which are controlled by the leveling device 160. Further, the front bogie 11 and the rear bogie 12 are coupled to each other via the front side coupling support mechanism and the rear side coupling support mechanism comprised of the carbody vertical motion absorber mechanism 140 and the coupling member 351, and, further via the support mechanisms 310 provided on both sides in the vehicle width directions 21, i.e., the front side lever member 3111, the bar steel member 312, and the rear side lever member 3112.

On the other hand, the front bogie 11 and the rear bogie 12 are displaced in the roll direction or the torsional direction with respect to the carbody 20, according to the orbital cant. The force at this time acts on each support mechanism 310 respectively from the front side coupling support mechanism of the front bogie 11 and the rear side coupling support mechanism of the rear bogie 12. As already described in Embodiment 7, each support mechanism 310 acts so that the front bogie 11 and the rear bogie 12 of the single vehicle are mutually pivotable in the torsional directions (i.e., rotation to the different directions) with respect to the carbody 20, and, on the other hand, so that they have rigidity in the roll direction (i.e., rotation to the same direction).

As a result of this operation, the decreases in wheel load can be prevented at both the front and rear bogies 11 and 12 of the single vehicle. In particular, it is effective in prevention of the decrease in wheel load in the curved cant gradually decreasing section. Further, also in the carbody support device 1011 of Embodiment 11, since it has the simple structure in which the reversing mechanism 113 is omitted from the carbody support devices 101-104 of Embodiments 1-4, it has peculiar effects that the configuration is easy in manufacturing and maintenances and the manufacturing cost can be reduced, similar to the case of Embodiment 7. Further, as described in the beginning of this embodiment, the diagonal beam 120 is not used in the carbody support device 1011. Therefore, in the bolsterless bogie which uses the air springs 17, it can adopt a configuration in which the existing bogie structure is used as it is and the support mechanism 350 is added. Therefore, it is possible to reduce the manufacturing cost also in terms of the matters described above. Further, since the diagonal beam 120 is not provided, there are also advantages that more space can be given around the bogie under the carbody floor and the weight of the vehicle can be reduced.

Next, a modification of the embody support device 1011 having the support mechanism 350 described above is described below with reference to FIG. 25. That is, a carbody support device 1012 which is the modification of the carbody support device 1011 has a support mechanism 360. In the support mechanism 360, the hydraulic circuit 340 described in Embodiment 9 as another example of the connecting mechanism in the support mechanism 350 is adopted instead of the bar steel member 312. The hydraulic circuit 340 includes the front side hydraulic cylinder 341, the rear side hydraulic cylinder 342, and the confinement piping 343 as already described. In the hydraulic circuit 340 of the support mechanism 360, each piston rod in the front side hydraulic cylinder 341 and rear side hydraulic cylinder 342 is oriented in the vertical directions, and is coupled to the other end of the coupling member 351 via the universal joint 352. The main parts of the front side hydraulic cylinder 341 and the rear side hydraulic cylinder 342 are fixed to the carbody 20. Further, the oil pressure compensation part 216 described in Embodiment 6 can be provided in the confinement piping 343. The oil pressure compensation part 216 includes the check valve 2161, the pressure relief valve 2162, and the accumulator 2163.

Note that the installed direction of the front side hydraulic cylinder 341 and the rear side hydraulic cylinder 342 is not limited to the direction described above. For example, as shown in FIG. 21, in the front side hydraulic cylinder 341 and the rear side hydraulic cylinder 342, the piston rods may be oriented in the vehicle longitudinal directions 22 and may be supported by the carbody 20. With this configuration, instead of the bar steel member 312 shown in FIG. 23, the front side hydraulic cylinder 341, the rear side hydraulic cylinder 342, and the confinement piping 343 are installed, and each of the other ends of the front side lever member 3111 and the rear side lever member 3112 is pivotably coupled to each piston rod of the front side hydraulic cylinder 341 and the rear side hydraulic cylinder 342.

Also in the carbody support device 1012 having the support mechanism 360 configured as described above, similar to the case of the carbody support device 1011 having the support mechanism 350, the front bogie 11 and the rear bogie 12 in the single vehicle act so that they are mutually pivotable in the torsional directions (i.e., rotation to the different directions) with respect to the carbody 20, and act so that they have rigidity in the roll direction (i.e., rotation to the same direction). Therefore, it is possible to prevent the decrease in wheel load at both the front and rear bogies of the single vehicle, and it is effective in the prevention of the decrease in wheel load especially in the curved cant gradually decreasing section. Further, if the space where the two bar steel members 312 are installed between the front bogie 11 and the rear bogie 12 cannot be secured on both sides of the carbody in the vehicle width directions 21, the hydraulic circuit 340 concerned can be an effective means. Further, similar to the configuration of Embodiment 9, the hydraulic circuit 340 which includes the front side hydraulic cylinder 341, the rear side hydraulic cylinder 342, and the confinement piping 343 can be mounted on the carbody 20 and transmits the displacement of each of the front and rear bogies 11 and 12 via the coupling member 351 and the carbody vertical motion absorber mechanism 140. By being configured as described above, the traveling vibration which acts on the hydraulic circuit 340, especially the traveling vibration from the front bogie 11 and the rear bogie 12 can be significantly reduced by the carbody vertical motion absorber mechanism 140 and the coupling member 351 and, thus, the reliability of the hydraulic circuit 340 can be improved. That is, the carbody vertical motion absorber mechanism 140 and the coupling member 351 in the support mechanism 360 correspond to the absorber mechanism 321 of Embodiment 9.

Further, as already described in each of Embodiments 1-11, it is needless to say that each railway vehicle provided with the respective carbody support devices 101-409 and 1010-1012 can be manufactured. In each railway vehicle respectively provided with such carbody support devices 101-109 and 1010-1012, it is possible to absorb the displacement due to the orbital torsion with respect to the carbody 20 without performing the active control operation as preventive measures of the decreases in wheel load, and, as a result, it is possible to prevent the decrease in wheel load between the front and rear bogies per vehicle.

Further, since the carbody support device and the railway vehicle of each embodiment can absorb initial torsional displacements of the bolster springs with respect to the carbody and static wheel load unbalance of each of the front and rear bogies can be reduced, they do not need an equalizing work of bolster spring supporting heights by liner adjustment and, thus, work efficiency improves.

Note that, by suitably combining any of the above various embodiments, a configuration can be achieved in which respective effects are obtainable. Further, although the present invention is fully described of the desirable embodiments with reference to the accompanying drawings, various modifications and corrections are apparent to the person skilled in the art. It should be understood that such modifications and corrections are included in the present invention unless otherwise departing from the scope of the present invention described in the appended claims. Further, the entire disclosures of respective specifications, drawings, claims, and abstracts of Japanese Patent Application No. 2012-157877 filed on Jul. 13, 2012 and Japanese Patent Application No. 2013-35607 filed on Feb. 26, 2013 are incorporate herein by reference.

INDUSTRIAL APPLICABILITY

The present invention is applicable to the carbody support device for suppressing variation in the wheel load of the railway vehicle, and to the railway vehicle provided with the carbody support device.

DESCRIPTION OF REFERENCE NUMERALS

11: Front Bogie; 12: Rear Bogie; 13: Bogie Frame; 17: Air Spring; 20: Carbody; 21: Vehicle Width Directions; 22: Vehicle Longitudinal Directions; 101-109, 1010-1012: Carbody Support Device; 110: Support Mechanism; 111: First Anti Rolling Bar; 112: Second Anti Roiling Bar; 113: Reversing Mechanism; 115: Linkage Mechanism; 120: Diagonal Beam; 121: Front Diagonal Beam; 122: Rear Diagonal Beam; 130: Coupling Support Mechanism; 131: Coupling Member; 132: Support Member; 140: Carbody Vertical Motion Absorber Mechanism; 150: Coupling Piping; 160: Leveling Device; 170, 180: Bolster; 210: Support Mechanism; 211; Hydraulic Cylinder; 215: Confinement Piping; 310, 320, 330, 350, 360: Support Mechanism; 311: Lever Member; 311*a*; One End; 311*b*: The Other End; 311*c*: Fulcrum; 312: Bar Steel Member; 321: Absorber Mechanism; 340: Hydraulic Circuit; 341: Front Side Hydraulic Cylinder; 342: Rear Side Hydraulic Cylinder; 343: Confinement Piping; 3111: Front Side Lever Member; and 3112: Rear Side Lever Member.

The invention claimed is:

1. A carbody support device of a railway vehicle comprising support mechanisms respectively installed between a front bogie and a carbody and between a rear bogie and the carbody in a traveling direction, and supporting the carbody against the respective bogies, wherein each of the front and rear bogies has a bogie frame where an air spring is provided on an upper surface of the bogie frame on both sides in the vehicle width directions, wherein the support mechanisms include:

diagonal beams provided between the air springs and the carbody corresponding to the front bogie and the rear bogie, respectively, and each of the diagonal beams extending in the vehicle width directions and rollably supported by the carbody at a substantially center position in the vehicle width directions, the diagonal beams having a front diagonal beam and a rear diagonal beam;

confinement pipings configured to arrange at both sides in the vehicle width directions, extend in vehicle longitudinal directions, and confine incompressible fluid therein; and a pair of hydraulic cylinders configured to be disposed between respective both ends of the confinement pipings in the vehicle longitudinal directions and the same ends in width directions of the front and rear bogies, and communicate with the respective confinement pipings, wherein the hydraulic cylinders configured to be provided at ends of the front and rear diagonal beams in the vehicle width directions, respectively, between the diagonal beam and the carbody, wherein, in a state that one of the front and rear bogies is inclined to inclination direction with respect to the carbody, when one diagonal beam related to the one of bogies is inclined to the inclination direction with a force acted from a track to the one of bogies, a compressive force acts on a hydraulic cylinder on the one diagonal beam and makes the other diagonal beam related to the other of bogies be inclined to direction opposite to the inclination direction, whereby the support mechanisms permit the other of bogies inclining to a different direction with respect to the inclination of the one of bogies in the vehicle width directions; and in a state that a force from the track inclining the front and rear bogies in the same direction in the vehicle width directions with respect to the carbody acts, the front and rear diagonal beams are inclined in the same vehicle width direction, no force acts on the hydraulic cylinders arranged on the same side in the vehicle width direction on both the front and rear bogies, whereby the support mechanisms regulate both the front and the rear bogies inclining in the same vehicle width direction with respect to the carbody.

2. A carbody support device of a railway vehicle comprising support mechanisms respectively installed between a front bogie and a carbody and between a rear bogie and the carbody in a traveling direction, and supporting the carbody against the respective bogies, wherein the support mechanisms include:

confinement pipings configured to arrange at both sides in the vehicle width directions, extend in vehicle longitudinal directions, and confine incompressible fluid therein; and a pair of hydraulic cylinders configured to be disposed between respective both ends of the confinement pipings in the vehicle longitudinal directions and the same ends in width directions of the front and rear bogies, and communicate with the respective confinement pipings, wherein each of the front and rear bogies includes a bogie frame, and a bolster having a center pivot provided at the center in the vehicle width directions and side bearers provided on both sides in the vehicle width directions, the bolster being provided to an upper part of the bogie frame, wherein each bolster is configured to be rollable with respect to each of the respective bogie frames of the front and rear bogies about at the positions of the center pivots, wherein, in a state that one of the front and rear bogies is inclined with respect to the carbody, a compressive force acts on a hydraulic cylinder on the one of bogies, whereby the support mechanisms permit the other of bogies inclining to a different direction with respect to the inclination of the one of bogies in the vehicle width directions; and in a state that a force from the track inclining the front and rear bogies in the same direction in the vehicle width directions with respect to the carbody acts, no force acts on the hydraulic cylinders arranged on the same side in the vehicle width direction on both the front and rear bogies, whereby the support mechanisms regulate both the front and the rear bogies inclining in the same vehicle width direction with respect to the carbody.

3. The carbody support device of claim 1, further comprising compensation parts connected with the respective confinement pipings, for compensating abnormal pressures in the respective pipings.

4. A railway vehicle comprising the carbody support device of claim 1.

5. The carbody support device of claim 2, further comprising compensation parts connected with the respective confinement pipings, for compensating abnormal pressures in the respective pipings.

6. A railway vehicle comprising the carbody support device of claim 2.

* * * * *